US009415415B1

(12) United States Patent
Jones

(10) Patent No.: US 9,415,415 B1
(45) Date of Patent: Aug. 16, 2016

(54) LIQUID DIVIDING MODULE FOR VARIABLE OUTPUT DISPENSING APPLICATOR AND ASSOCIATED METHODS

(71) Applicant: Nordson Corporation, Westlake, OH (US)

(72) Inventor: Kenneth Jones, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 0 days.

(21) Appl. No.: 14/640,794

(22) Filed: Mar. 6, 2015

(51) Int. Cl.

| | |
|---|---|
| ***B05B 7/00*** | (2006.01) |
| ***B05B 7/08*** | (2006.01) |
| ***B05C 1/02*** | (2006.01) |
| ***B05C 5/02*** | (2006.01) |
| ***B05C 11/10*** | (2006.01) |

(52) U.S. Cl.
CPC ..... *B05C 5/0225* (2013.01); *B05C 11/1039* (2013.01); *B05B 7/0861* (2013.01); *B05C 5/0237* (2013.01); *B05C 5/0279* (2013.01)

(58) Field of Classification Search
CPC .. B05C 5/0225; B05C 5/0279; B05C 5/0237; B05C 11/1039; B05B 7/1468; B05B 7/0861
See application file for complete search history.

(56) References Cited

U.S. PATENT DOCUMENTS

| | | | | |
|---|---|---|---|---|
| 6,089,413 | A | 7/2000 | Riney et al. | |
| 6,422,428 | B1 | 7/2002 | Allen et al. | |
| 6,457,608 | B1 * | 10/2002 | Riney | B05C 5/0279 222/135 |
| 6,669,057 | B2 * | 12/2003 | Saidman | B05C 5/001 137/375 |
| 8,413,848 | B2 * | 4/2013 | McGuffey | B05C 5/0279 222/146.5 |
| 2005/0236430 | A1 * | 10/2005 | Clark | B05B 7/0861 222/146.2 |
| 2013/0274700 | A1 | 10/2013 | Harris | |

* cited by examiner

*Primary Examiner* — Frederick C Nicolas
(74) *Attorney, Agent, or Firm* — Baker & Hostettler LLP

(57) ABSTRACT

A liquid dividing module is located between a manifold and a dispensing module in a variable output dispensing applicator, to thereby enable the applicator to dispense patterns of adhesive onto a substrate, such as striped patterns and box-shaped patterns defined by zones of full volume adhesive and zones of reduced volume adhesive. The liquid dividing module divides a full volume flow of adhesive at a liquid inlet into first and second partial flows of adhesive, one of which continuously flows to a liquid outlet and another of which is controlled to either be recirculated or delivered to the liquid outlet. The different operating states of the liquid dividing module therefore enable highly responsive and rapid switching between the reduced volume output and a full volume output immediately before discharge at the dispensing module.

15 Claims, 9 Drawing Sheets

LIQUID DIVIDING MODULE FOR VARIABLE OUTPUT DISPENSING APPLICATOR AND ASSOCIATED METHODS

TECHNICAL FIELD

The present invention relates generally to modules used with applicators for dispensing a pattern of adhesive onto a substrate, and more particularly, relates to modules configured to enable variation of adhesive flow rates along and transverse to a machine direction defined by substrate movement past the applicator.

BACKGROUND

Thermoplastic materials, such as hot melt adhesive, are dispensed and used in a variety of situations including the manufacture of diapers, sanitary napkins, surgical drapes as well as many others. This technology has evolved from the application of linear beads or fibers of material and other spray patterns, to air-assisted applications, such as spiral and meltblown depositions of fibrous material.

Often, the adhesive applicators will include one or more dispensing modules for applying the intended deposition pattern. Many of these modules include valve components to operate in an on/off fashion. One example of a dispensing module is disclosed in U.S. Pat. No. 6,089,413, assigned to the assignee of the present invention. This module includes valve structure which changes the module between ON and OFF conditions relative to the dispensed material. In the OFF condition, the module enters a recirculating mode. In the recirculating mode, the module redirects the pressurized adhesive material from the liquid material inlet of the module to a recirculation outlet which, for example, leads back into a supply manifold and prevents the adhesive material from stagnating. In the ON condition, the module delivers the adhesive material to a dispensing outlet for deposition on the substrate. Many other modules or valves have also been used to provide selective metering and on/off control of material deposition. For example, the known dispensing modules may be configured for contact dispensing or non-contact dispensing, such as spray dispensing, onto the target substrate to form the intended adhesive deposition pattern.

Various dies or applicators have also been developed to provide the user with some flexibility in dispensing material from a series of dispensing modules. For short pattern lengths, only a few dispensing modules are mounted to an integral manifold block. Longer applicators may be assembled by adding additional modules to the manifold. Additional flexibility may be provided by using different die tips or nozzles on the modules to permit a variety of deposition patterns across the applicator as well. The most common types of air-assisted dies or nozzles include meltblowing dies, spiral nozzles, and spray nozzles. Pressurized air used to either draw down or attenuate the fiber diameter in a meltblowing application, or to produce a particular deposition pattern, is referred to as process air. When using hot melt adhesives, or other heated thermoplastic materials, the process air is typically also heated so that the process air does not substantially cool the thermoplastic adhesive material prior to deposition of the adhesive material on the substrate or carrier. Therefore, the manifold or manifolds used conventionally to direct both adhesive material and process air to the module include heating devices for bringing both the thermoplastic material and process air to an appropriate application temperature.

In addition, it is also known that some articles of manufacture benefit from the use of reduced amounts of adhesive applied along certain portions of a deposition pattern. In order to achieve this varying amount of adhesive, multiple pumps and multiple valves are provided to feed a single dispensing outlet in the dispensing module (or two dispensing outlets configured to apply adhesive on the same portion of the substrate). One example of this type of system is disclosed in U.S. Patent Publication No. 2013/0274700, which is assigned to the assignee of the present invention. Such a system enables predictable variations in flow along a machine direction to thereby use reduced amounts of adhesive when these types of patterns are beneficial.

Despite these various improvements, it would be desirable to further enhance the operational functionality and efficiency of applicators for dispensing adhesive in various adhesive deposition patterns. To this end, it would be desirable to enable near-instantaneous modification of adhesive output volume without requiring duplicative valve and pump structures that can add to manufacturing costs and maintenance requirements for an applicator. Furthermore, it would be desirable to provide further adjustable control of the amount of reduction of adhesive flow when switching between partial volume flow and full volume flow in these dispensing applications, and particularly without using complex variable pump devices and control systems.

SUMMARY

In accordance with one embodiment, a liquid dividing module is configured to supply adhesive from a manifold to a dispensing module in a variable output dispensing applicator. The liquid dividing module includes a module body with a proximal wall configured to abut the manifold and a distal wall configured to abut the dispensing module. A liquid inlet is located in the proximal wall and is configured to receive a full volume flow of adhesive from the manifold, while a liquid outlet is located in the distal wall and is configured to deliver the full volume flow or a reduced volume flow of adhesive to the dispensing module. The liquid dividing module further includes a valve chamber positioned in the module body and housing a valve member, a first internal passage extending from the liquid inlet to the liquid outlet, and a second internal passage that extends from the liquid inlet to the valve chamber, and then from the valve chamber to the liquid outlet. The full volume flow of adhesive is divided at the liquid inlet into a first partial flow of adhesive that continuously moves to the liquid outlet via the first internal passage and a second partial flow of adhesive which moves through the second internal passage to the valve chamber. The liquid dividing module also includes a recirculation outlet configured to communicate with the manifold and a recirculation passage communicating with the valve chamber and the recirculation outlet. The valve member moves between an open position enabling the second partial flow of adhesive to continue moving through the second internal passage so as to be rejoined with the first partial flow of adhesive to provide the full volume flow at the liquid outlet, and a closed position blocking flow through the second internal passage and thereby providing only the reduced volume flow at the liquid outlet. The second partial flow of adhesive is directed to flow into the recirculation passage towards the recirculation outlet when the valve member is moved to the closed position. As a result, the dispensing module of the applicator can be rapidly switched between receiving the full volume flow and the reduced volume flow of adhesive.

In one aspect, the dispensing module may also recirculate flow in a closed position, so the liquid dividing module further includes a recirculation inlet configured to receive this recirculation flow and deliver it to the recirculation passage and recirculation outlet for flow back towards the manifold.

In some embodiments, the recirculation passage defines a bore with a fixed, predetermined diameter which controls the recirculation flow so as to provide a fixed percentage drop in flow of adhesive in the reduced volume flow compared to the full volume flow. For example, the fixed percentage drop enabled by the recirculation passage is 50% reduction of volume in one exemplary embodiment. In alternative arrangements, the recirculation passage defines a bore with an adjustable diameter, thereby to provide a variable percentage drop in flow of adhesive in the reduced volume flow compared to the full volume flow. In such an arrangement, the liquid dividing module further includes a removable bead tip selectively engaged with the bore of the recirculation passage to modify the diameter of the recirculation passage and thereby modify the percentage drop in flow of adhesive between operating states.

In another aspect of the liquid dividing module, a removable cartridge is inserted into the valve chamber for interaction with the valve member. The valve chamber and the removable cartridge collectively define a first path for the second partial flow of adhesive to move between the liquid inlet and liquid outlet, and a second path for the second partial flow of adhesive to move between the liquid inlet and the recirculation passage. The removable cartridge further includes a first valve seat located along the first path and a second valve seat located along the second path. The valve member includes a first enlarged valve element configured to selectively engage with the first valve seat and a second enlarged valve element configured to selectively engage with the second valve seat. More particularly, the first and second enlarged valve elements are configured to alternatively engage with the first and second valve seats to open flow through one of the first and second paths at all times. The first and/or second enlarged valve element is also partially defined by a removable sleeve to enable assembly of the valve member with the removable cartridge.

In yet another aspect of the liquid dividing module, a piston chamber is defined within the module body, and a piston is coupled to the valve member for movement with the valve member in the piston chamber. An air control valve is configured to selectively provide pressurized control air into the piston chamber to drive the piston and the valve member between the open and closed positions. The liquid dividing module also includes a spring biasing the piston to move the valve member towards the closed position, particularly when the air control valve does not provide pressurized control air into the piston chamber. The liquid dividing module further includes a central control air passage configured to deliver the pressurized control air from the air control valve to the piston chamber, and a control air supply passage. The control air supply passage receives pressurized control air from the manifold and delivers it to at least one of the dispensing module and the air control valve. The control air supply passage includes multiple passage portions angled from one another such that the control air supply passage bends around the central control air passage.

In further embodiments, the first internal passage of the liquid dividing module includes multiple passage portions angled from one another such that the first internal passage bends around the valve chamber. Similarly, when the dispensing module is a non-contact module which sprays the adhesive onto a substrate, the liquid dividing module includes a process air transmission passage for delivering pressurized process air from the manifold to the dispensing module. The process air transmission passage includes multiple passage portions angled from one another such that the process air transmission passage bends around the valve chamber.

In accordance with another embodiment, a method for supplying a variable amount of adhesive from a manifold to a dispensing module using a liquid dividing module is provided. The liquid dividing module includes any or all of the features described above. The method includes dividing a full volume flow of adhesive at a liquid inlet into first and second partial flows of adhesive, and transmitting the first partial flow of adhesive continuously to a liquid outlet. The second partial flow of adhesive is controlled in the liquid dividing module to selectively enable transmission of the second partial flow of adhesive to the liquid outlet in a first operating state, and to selectively block transmission of the second partial flow of adhesive from continuing to move to the liquid outlet in a second operating state. When the liquid dividing module is in the first operating state, the first and second partial flows of adhesive are recombined at the liquid outlet to provide the full volume flow from the liquid outlet. When the liquid dividing module is in the second operating state, only the first partial flow of adhesive is delivered to the liquid outlet as a reduced volume flow of adhesive. The method also includes moving the valve member to an open position in the first operating state to enable transmission of the second partial flow of adhesive between the liquid inlet and the liquid outlet, and moving the valve member to a closed position in the second operating state to divert the second partial flow of adhesive from the liquid inlet to the recirculation passage. To this end, controlling the second partial flow of adhesive includes closing a recirculation path between the liquid inlet and the recirculation passage, and opening the recirculation path between the liquid inlet and the recirculation passage. This method is explained in further detail below as well, and the use of the liquid dividing module improves the functionality and responsiveness of dispensing patterns of adhesive onto a substrate with varying flows of adhesive when using the applicator, such as in the nonwovens construction field.

These and other objects and advantages of the disclosed apparatus will become more readily apparent during the following detailed description taken in conjunction with the drawings herein.

DETAILED DESCRIPTION

Figure 1:
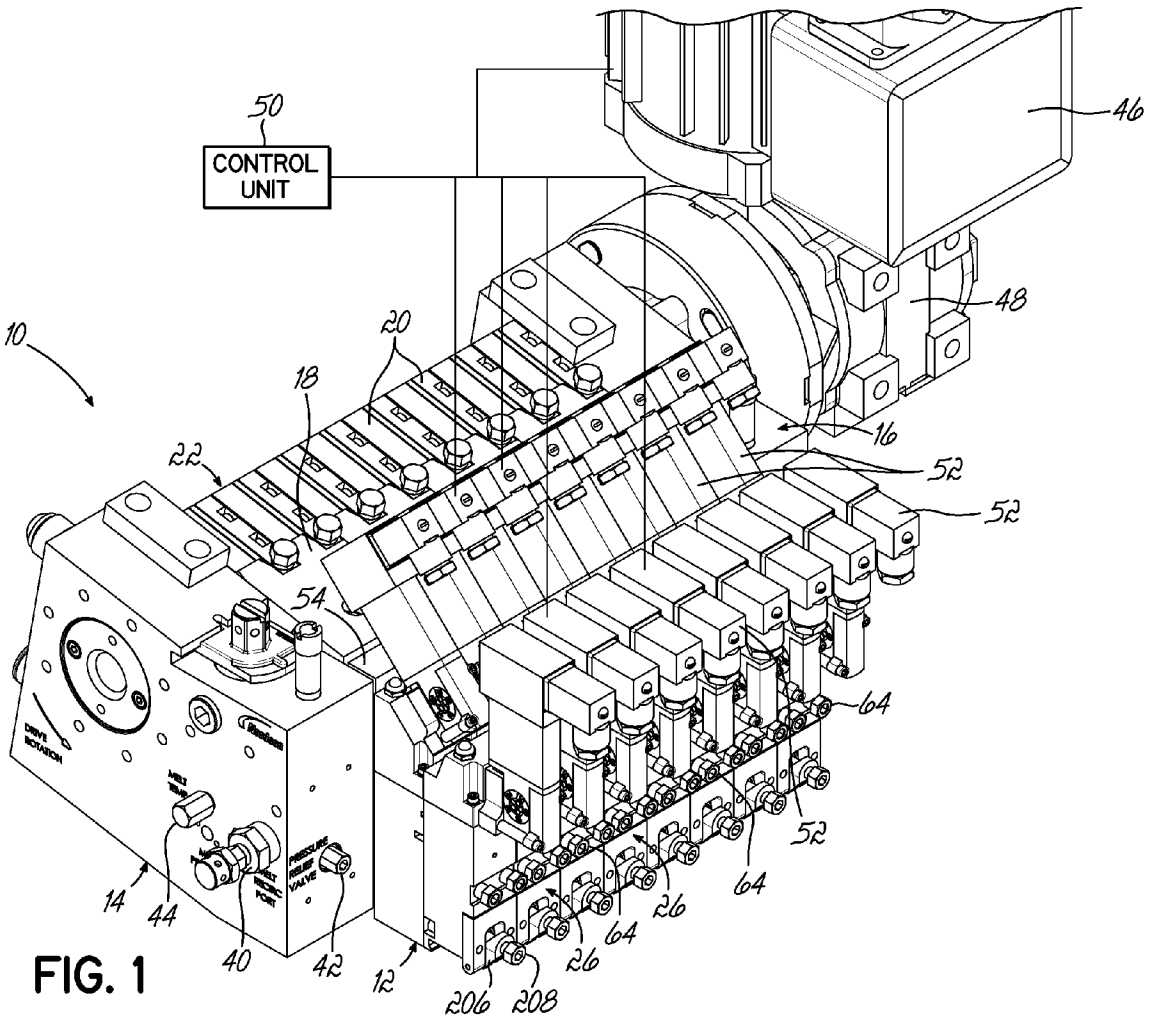
FIG. 1 is a front perspective view of a variable output dispensing applicator including a plurality of liquid dividing modules in accordance with one embodiment of the invention, the applicator also including a manifold and a plurality of liquid dispensing modules sandwiching the plurality of liquid dividing modules.

FIGS. 1 through 8A illustrate one embodiment of a variable output dispensing applicator 10 including at least one liquid dividing module 12 constructed in accordance with the concepts of this disclosure. To this end, the applicator 10 is configured to dispense patterns of adhesive onto a substrate moving with respect to the applicator 10, the patterns being defined at least by zones of full volume flow/output and zones of reduced volume flow/output. Rather than providing duplicative overlapping dispensing structures to control two partial adhesive flows that may be dispensed onto each area of the substrate, the applicator 10 advantageously includes a plurality of liquid dividing modules 12 (also referred to as "liquid dividing, supplying and recirculating modules") that divide a full volume flow and selectively control whether a partial portion of the full volume flow reaches the corresponding associated dispensing modules. As a result, the adhesive flow variation is controlled in line with and immediately before delivery of the adhesive into the dispensing modules, which allows for increased responsiveness when dispensing patterns or states need to be changed during operation of the applicator 10. Therefore, one or more desired patterns of adhesive, several examples of which are described in further detail below, can be reliably applied to the substrate with less adhesive material waste when using the applicator 10 of the current embodiment.

In addition to the liquid dividing modules 12, the applicator 10 includes many similar components as the modular dispensing applicator described in U.S. Pat. No. 6,422,428, assigned to the assignee of the present invention, and the disclosure of which is hereby fully incorporated by reference herein. To this end, the applicator 10 includes a pair of end plates 14, 16 sandwiching a plurality of individual side-by-side manifold segments 18 therebetween, with each of the manifold segments 18 being associated with a corresponding gear pump 20. The manifold segments 18 and end plates 14, 16 collectively define a manifold 22 of the applicator 10. These elements of the applicator 10 are shown in a fully assembled state in FIG. 1.

In general, a pressurized liquid adhesive such as hot melt adhesive is introduced into manifold segments 18 and is then metered by the gear pumps 20 individually associated with each manifold segment 18. This flow of adhesive is supplied to the liquid dividing modules 12 via a plurality of liquid discharge outlets (not shown), at least one of which is formed in each of the manifold segments 18 for communication with a corresponding one of the liquid dividing modules 12. The liquid discharge outlets are effectively fed a metered flow of adhesive which is metered for each specific liquid dividing module 12 by the corresponding gear pump 20. Consequently, each of the liquid dividing modules is fed a "full volume" supply of adhesive from the corresponding manifold segment 18. The liquid dividing modules 12 then deliver some or all of this adhesive flow into a corresponding plurality of dispensing modules 26 located on an opposite side of the liquid dividing modules 12 as the manifold 22. As well understood, the dispensing modules 26 control whether the flow of adhesive received from the liquid dividing modules 12 is discharged onto the substrate or recirculated.

Before describing one of the liquid dividing modules 12 of this disclosure in further detail, several additional details regarding the surrounding elements in the applicator 10 merit brief additional attention. For example, the manifold segments 18 may also include additional inlets and outlets (not visible in the fully assembled view of FIG. 1) configured to communicate with the corresponding liquid dividing module (s) 12. For example, each manifold segment 18 of this embodiment includes a liquid recirculation inlet, which is configured to receive a partial portion or a full portion of the flow of adhesive when one or both of the liquid dividing module 12 and the dispensing module 26 are in a closed/recirculation mode. Consequently, the flow of adhesive does not stagnate within the applicator 10 during operation, even if the dispensing operation of adhesive onto substrate(s) is temporarily halted. Each manifold segment 18 also includes a process air outlet that is configured to deliver pressurized process air to the liquid dividing module 12 for passing on to the dispensing module 26, such as when process air is required for non-contact spray dispensing at the dispensing module 26. Similarly, each manifold segment 18 includes an air block 54 with a pressurized air outlet configured to supply pressurized control air into the liquid dividing module 12 and the dispensing module 26 for use by pneumatic control elements associated with and controlling operation of each of the modules. The corresponding passages for receiving such air and adhesive flows in the liquid dividing module 12 from these inlets and outlets of the manifold 22 are described in further detail below.

As readily understood in the hot melt dispensing field, the manifold 22 is typically heated using heater cartridges or similar elements (not shown) extending through the manifold segments 18 and optionally through one or both of the end plates 14, 16 as well. The internal passageways for liquid adhesive and for process air in the manifold 22 are designed to enable heating of the air and adhesive to keep these elements at desirable temperature levels upon discharge from the dispensing modules 26. One particular layout of these internal manifold passages is described in the U.S. Pat. No. 6,422,428 referenced above, although no further detail is shown in the drawings or described herein.

Returning to the end plates 14, 16, at least one of the end plates 14 (the one closest to the front in FIGS. 1 and 2) includes an inlet port for adhesive (not shown), an outlet port 40 for recirculating adhesive, and a pressure relief port 42 configured to discharge adhesive if the adhesive in the applicator 10 becomes over-pressurized. This end plate 14 may also include a temperature sensor 44 configured to measure and monitor the temperature of the liquid adhesive in the manifold 22, thereby to provide control to the heating elements described briefly above. The incoming adhesive material may also be transferred through a filter block (not shown) which may be secured to the end plate 14 in some embodiments. On the opposing end plate 16 in the embodiment shown in these Figures, a DC servo motor 46 and a right angle gear box 48 are provided to simultaneously drive each gear pump 20 coupled with the manifold segments 18. To this end, the servo motor 46 in this embodiment is connected to a control unit 50 of the applicator 10, shown schematically, the control unit 50 causing the servo motor 46 to drive a drive shaft extending from the gear box 48 through each of the adjacent gear pumps 20.

As shown schematically in FIG. 1, the control unit 50 of the applicator 10 is also operatively coupled to a plurality of air control valves in the form of air solenoids 52 which are the pneumatic control elements referred to above. Each of the plurality of air solenoids 52 is a conventional spool operated solenoid valve that is coupled to the upper portion of one of the liquid dividing modules 12 or one of the dispensing modules 26. The air solenoids 52 control air flow to the pneumatically-driven valve devices located inside the liquid dividing modules 12 and the dispensing modules 26, as set forth in greater detail below at least for the liquid dividing module 12. Therefore, the control unit 50 of this embodiment is capable of operating the air solenoids 52 in a manner to cause the applicator 10 to dispense a specified pattern of adhesive on the substrate.

The applicator 10 is assembled in this embodiment by connecting the liquid dividing modules 12 and dispensing modules 26 to the corresponding manifold segments 18 using elongated and threaded assembly fasteners 64, the heads of which are shown in FIG. 1. To this end, each of the liquid dividing modules 12 and dispensing modules 26 includes fastener through holes 62 (see FIG. 2 for example) that extend between proximal and distal sides ("proximal" and "distal" being implied relative to the manifold 22) of these elements. The fastener through holes 62 are positioned to be aligned with threaded apertures provided in the manifold segments 18. To this end, the threaded assembly fasteners 64 extend through one of the liquid dividing modules 12 and one of the dispensing modules 26 so as to be threadably engaged with the corresponding threaded aperture in a manifold segment 18, and tightening the threaded engagement sandwiches the liquid dividing module 12 in close contact with and between the manifold 22 and the dispensing module 26. As will be readily understood, these threaded apertures and threaded assembly fasteners 64 may be repositioned in other embodiments, but are provided at a centralized location in the illustrated embodiment because this area corresponds to a good area to provide balanced support for the elements being assembled together to form the applicator 10. Regardless of the assembly mechanisms chosen, the applicator 10 may be configured in many different manners, such as with differing numbers of manifold segments 18, liquid dividing modules 12, and dispensing modules 26, depending on the particular application needs of the user.

It is further noted that various embodiments of the applicator 10 may include different types of dispensing modules 26 (such as contact and non-contact dispensing modules) and different layouts or structures at the manifold 22 without departing from the scope of the described invention. Other modifications will be readily apparent and within the scope of this disclosure, such as, for example, the potential replacement of one or more gear pumps with a substitution block (not shown) which diverts adhesive material back into the corresponding manifold segment, as well as those alternatives described above. The provision of the liquid dividing modules 12 within the applicator 10 helps enable the advantageous functionality and dispensing variety of patterns described below.

With reference to FIGS. 2 through 8A, one of the liquid dividing modules 12 used with the applicator 10 described briefly above is shown in detail, in accordance with one exemplary embodiment of this disclosure. The liquid dividing module 12 is advantageously configured to selectively reduce a full volume flow of adhesive received from the corresponding manifold segment 18 to a reduced or partial volume flow of adhesive adjacent to and immediately before that adhesive flow is delivered into and selectively dispensed by the corresponding dispensing module 26. Accordingly, the dispensing module 26 can switch between dispensing a full volume flow and a partial volume flow rapidly on demand by virtue of operating the liquid dividing module 12 feeding the adhesive into the dispensing module 26. To this end, the quick responsiveness to control signals from the control unit 50 when modifying the amount of adhesive dispensed at the dispensing module 26 provides effective and predictable (e.g., controllable) patterns of deposition onto a substrate, which is advantageous in certain fields such as nonwoven garment construction.

Figure 2:
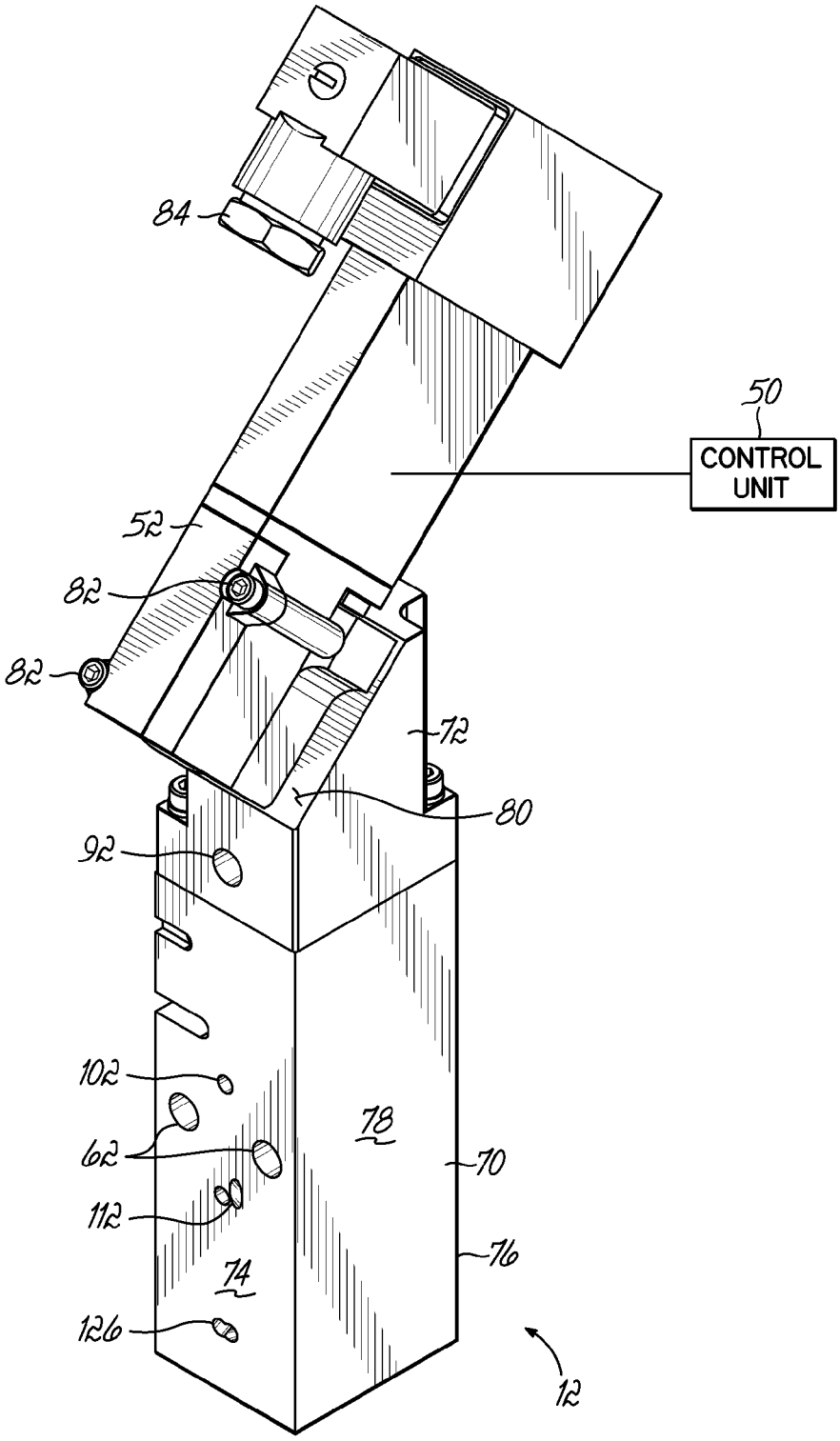
FIG. 2 is a front perspective view of one of the liquid dividing modules used with the applicator of FIG. 1.
Figure 3:
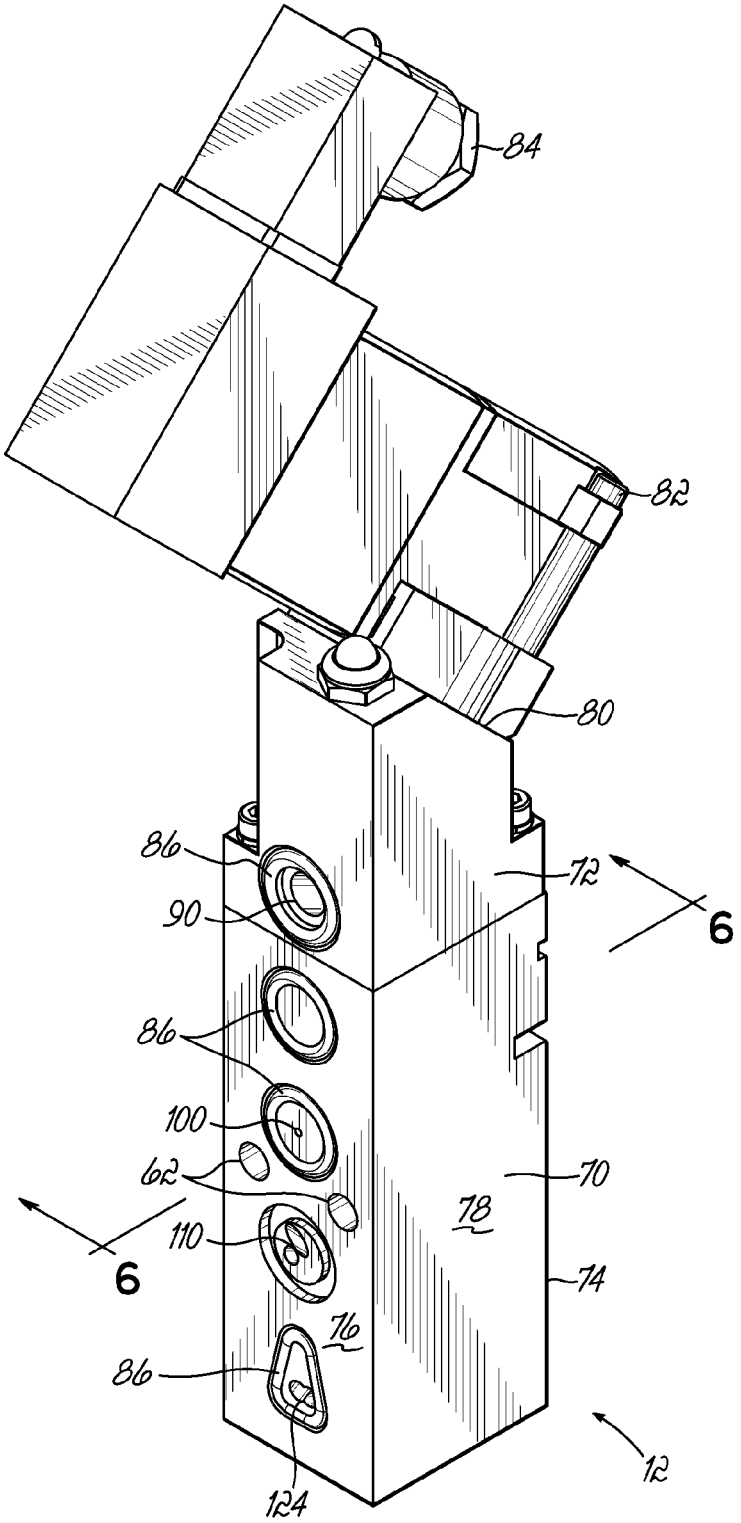
FIG. 3 is a rear perspective view of the liquid dividing module of FIG. 2.

The external appearance and features of the liquid dividing module 12 of this embodiment are shown in FIGS. 2 and 3. The liquid dividing module 12 includes a module body defined by a liquid control section 70 and a control air section 72 mounted on top of the liquid control section 70. The liquid control section 70 is generally rectangular box-shaped in appearance, with an outer periphery defined by a distal wall 74 facing towards the dispensing module 26, a proximal wall 76 facing towards the manifold 22, and sidewalls 78 extending between the distal wall 74 and proximal wall 76. The control air section 72 provides an angled top mounting surface 80 for attaching the corresponding air solenoid 52 to, such as with threaded fasteners 82. As previously shown in the view of the entire applicator 10 in FIG. 1, this enables the air solenoid 52 on the liquid dividing module 12 to be in an inclined position that does not interfere with the dispensing module 26 or its associated air solenoid 52. The air solenoid 52 of this and other views in this application is a conventional commercially-available device including internal valve structure and a port 84 for connecting to an electrical supply and/or the control unit 50, but no further explanation of this element or its functionality will be necessary here to understand the scope of the recited invention.

With continued reference to FIGS. 2 and 3, the liquid dividing module 12 includes a series of inlets and outlets for the flow of process air, adhesive, and control air. Each of these elements is passed through the liquid dividing module 12 into the dispensing module 26 as set forth in further detail below, this arrangement resulting from the positioning of the liquid dividing module 12 directly between the manifold segment 18 and the dispensing module 26. It will also be understood that each of the following inlets and outlets can be repositioned from the particular layout described below to make the liquid dividing module 12 compatible with other port arrangements provided in a manifold 22 and dispensing modules 26 in different embodiments of the applicator 10. Furthermore, although sealing grooves with seal gaskets 86 are shown only along the inlets/outlets provided on the proximal wall 76, it will be appreciated that these elements could instead be provided on the distal wall 74 and/or on the corresponding surfaces of the manifold 22 and/or the dispensing module 26 in contact with the distal wall 74 and proximal wall 76 in similar embodiments.

Beginning with the control air section 72, the liquid dividing module 12 includes a control air inlet 90 positioned just above the proximal wall 76 of the liquid control section 70. The liquid dividing module 12 also includes a control air outlet 92 on an opposite side of the liquid dividing module 12 (but still at the control air section 72), for example, above the distal wall 74 of liquid control section 70. The control air inlet 90 is positioned into alignment and communication with the pressurized air outlet located in the air block 54 of the corresponding manifold segment 18. This pressurized air flow from the air block 54 is continuously passed through a control air passage 94 extending between the control air inlet 90 and control air outlet 92 such that this pressurized air flow is also made available to the dispensing module 26 for use by its associated air solenoid 52. As described below, this control air passage 94 also communicates with the control structure of the air solenoid 52 mounted on the liquid dividing module 12 such that the air solenoid 52 determines whether this pressurized control air reaches a piston within the liquid dividing module 12. Therefore, the liquid dividing module 12 both utilizes the pressurized air and passes this air along for later use at the dispensing module 26.

Figure 4:
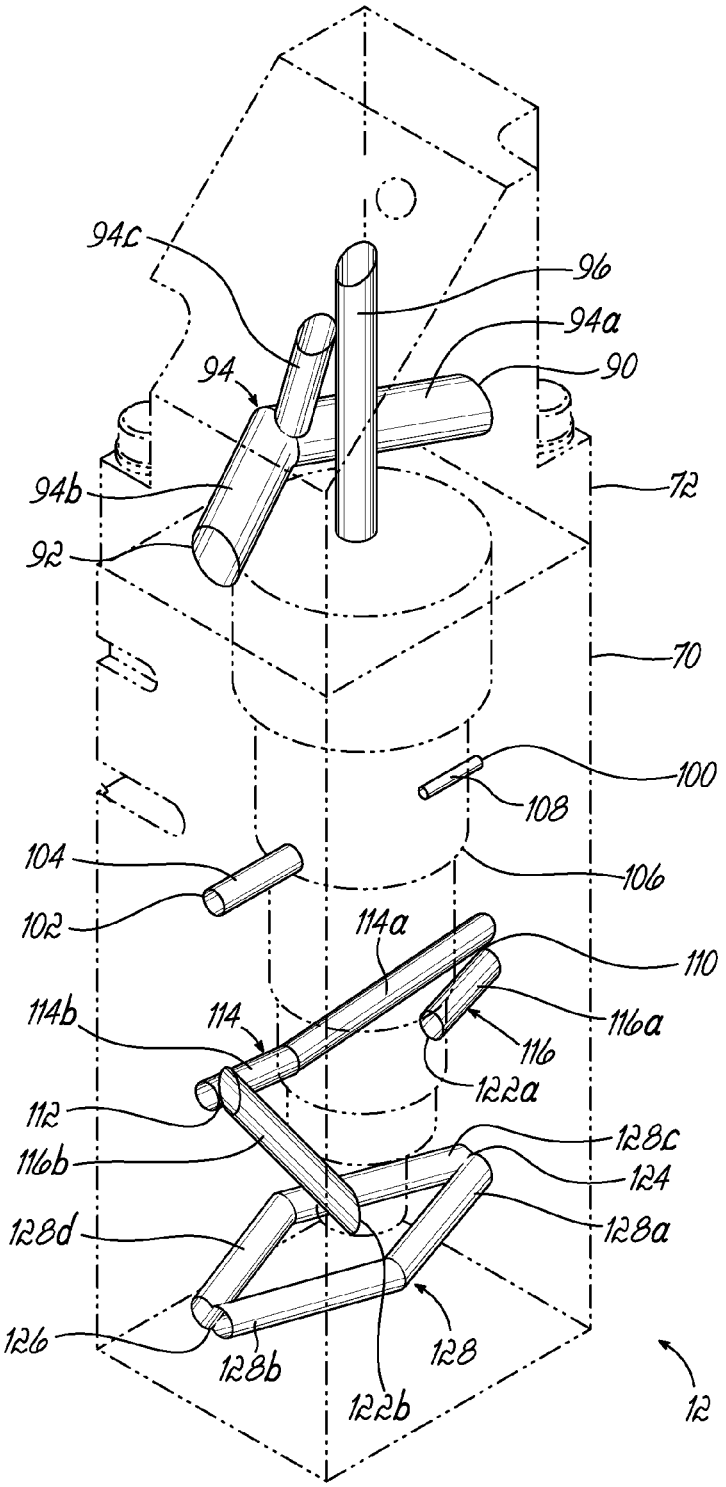
FIG. 4 is a partially-phantom front perspective view of the liquid dividing module of FIG. 2 to show internal passages through the liquid dividing module in further detail.
Figure 5:
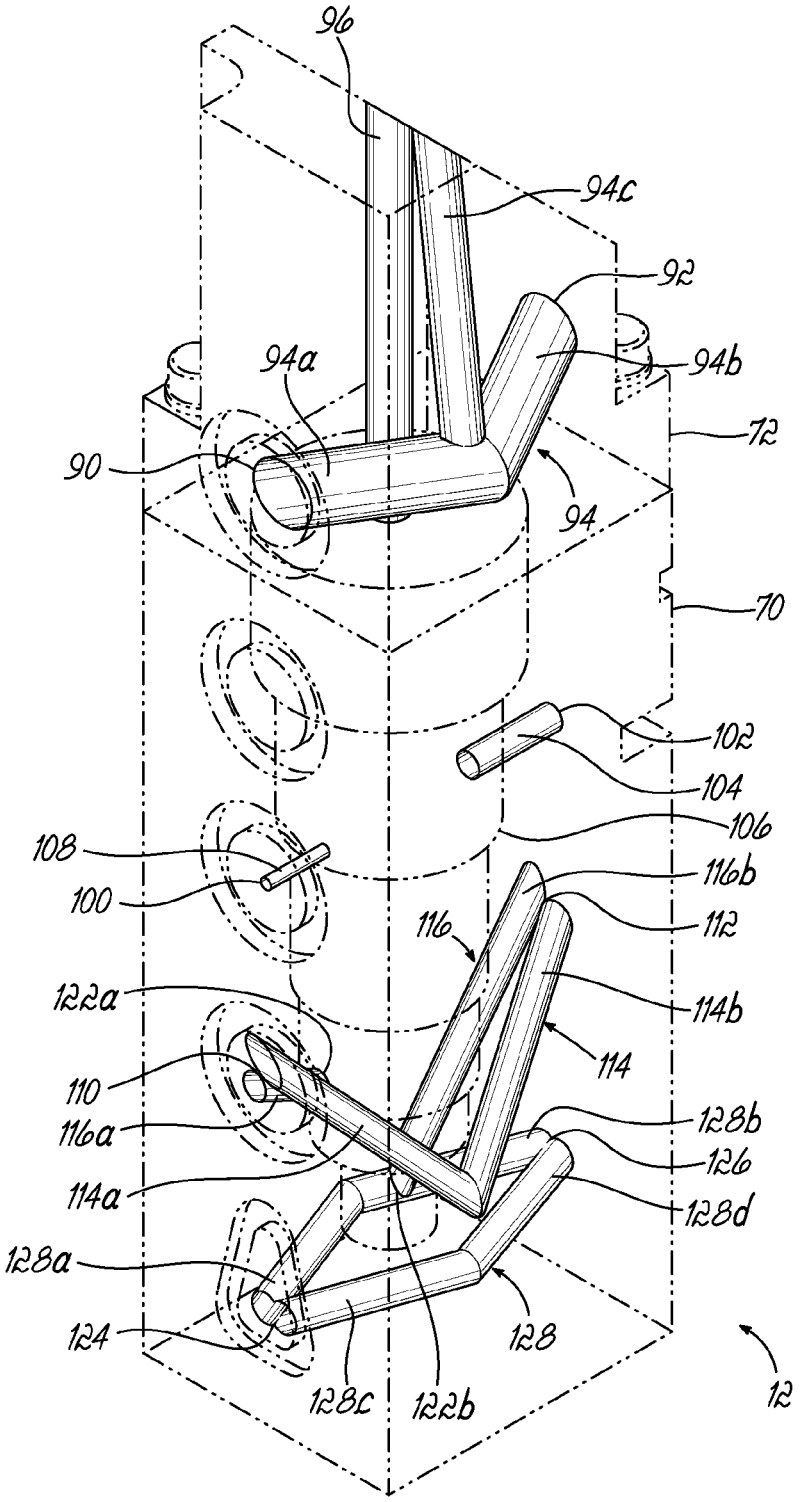
FIG. 5 is a partially-phantom rear perspective view of the liquid dividing module of FIG. 2 to show internal passages through the liquid dividing module in further detail.

As noted above, the control air inlet 90 is surrounded by a seal groove and a seal gasket 86 which is configured to prevent leaks of the pressurized air from the interface between the manifold 22 and the proximal wall 76 of the liquid dividing module 12. Turning momentarily to FIGS. 4 and 5, which show most of the solid structure of the liquid dividing module 12 in phantom so as to reveal paths of internal passages in this liquid dividing module 12, the control air passage 94 includes two passage segments 94*a*, 94*b* which are angled from one another. This relative angling of the passage segments 94*a*, 94*b* (each of which is a straight bore) enables the control air passage 94 to bend around internal central structure within the liquid dividing module 12, and more specifically, around a central control air passage 96 (shown in phantom in FIGS. 5 and 6) delivering flow from the air solenoid 52 when activated to the piston described below. The first passage segment 94*a* communicates with the control air inlet 90 and the second passage segment 94*b* communicates with the control air outlet 92. The control air passage 94 also includes a third passage segment 94*c* which branches off from one or both of the other passage segments 94*a*, 94*b* and extends into communication with the air solenoid 52 (e.g., via a port along a top surface of the control air section 72) so as to provide the pressurized air to the air solenoid 52, for selective delivery back through the central control air passage 96 as described below. The specific path taken by the bending control air passage 94 may be modified in other embodiments depending on where the central control air passage 96 is located in those other embodiments, for example.

Continuing downwardly from the top of the liquid control section 70 in FIGS. 3 and 4, the liquid dividing module 12 also includes a liquid recirculation outlet 100 located along the proximal wall 76 and a liquid recirculation inlet 102 located along the distal wall 74. As noted above, the recirculation outlet 100 is surrounded by a seal groove with a seal gasket 86 in the illustrated embodiment, but it will be appreciated that the recirculation inlet 102 or both of these may include such a seal groove in other embodiments. The recirculation outlet 100 is positioned into alignment and communication with the liquid recirculation inlet on the corresponding manifold segment 18 on the manifold 22. Accordingly, and as described in further detail below, the liquid dividing module 12 is capable of returning a partial portion or a full portion of the adhesive material to the manifold 22 when the dispensing module 26 is closed or only discharging a partial volume flow of the adhesive. As such, the recirculation outlet 100 defines part of the flow path which avoids stagnation of the adhesive within the liquid dividing module 12. The recirculation outlet 100 (and its associated outlet recirculation passage 108) is also advantageously sized to control the amount of adhesive which is recirculated during operation of the liquid dividing module 12. Moreover, the size of these elements may be adjustable in alternative embodiments, one of which is described in further detail below.

The recirculation inlet 102 of the liquid dividing module 12 is positioned so as to be in communication with a recirculation path within the dispensing module 26. Thus, regardless of the amount of flow of adhesive delivered by the liquid dividing module 12 into the dispensing module 26, the recirculation inlet 102 enables the return of that adhesive flow when the dispensing module 26 is closed, this flow then being recirculated into the manifold 22. The recirculation inlet 102 communicates with an inlet recirculation passage 104 in the liquid dividing module 12 that extends to a central valve chamber 106 shown in phantom in FIGS. 4 and 5, for example. The central valve chamber 106 is the location where the valve member (not shown in FIGS. 2 through 5) of the liquid dividing module 12 operates so that the central valve chamber 106 routes incoming and outgoing flows of adhesive from the appropriate inlets to the desired outlet(s). On the opposite side of the central valve chamber 106 from the inlet recirculation passage 104, an outlet recirculation passage 108 extends to communicate outgoing recirculated adhesive flow from the central valve chamber 106 to the recirculation outlet 100.

Therefore, this portion of the liquid dividing module 12 defines a recirculation path for adhesive flow coming from the dispensing module 26, this recirculation path defined by the recirculation inlet 102, the inlet recirculation passage 104, the central valve chamber 106, the outlet recirculation passage 108, and the recirculation outlet 100 in sequence. Likewise, the liquid dividing module 12 also defines a recirculation path for adhesive flow in the liquid dividing module 12 as follows: from the central valve chamber 106 through the outlet recirculation passage 108 and the recirculation outlet 100 in sequence.

Below the recirculation outlet 100 and recirculation inlet 102, the liquid dividing module 12 includes the fastener through holes 62 which extend all the way from the distal wall 74 to the proximal wall 76 so as to receive the elongated threaded assembly fasteners 64 connecting the liquid dividing module 12 in position between the dispensing module 26 and the manifold 22. The fastener through holes 62 are not shown in FIGS. 4 and 5, but they are laterally offset from the center of the liquid dividing module 12 so that the assembly fasteners 64 do not impinge upon the central valve chamber 106 located within the liquid dividing module 12.

Continuing to move downwardly from the fastener through holes 62 relative to the external view shown in FIGS. 2 and 3, the liquid dividing module 12 further includes a liquid inlet 110 located along the proximal wall 76 and a liquid outlet 112 located along the distal wall 74. The liquid inlet 110 is configured to be aligned into fluid communication with one of the liquid discharge outlets provided at the manifold 22, thereby enabling an incoming flow of adhesive to be received within the internal passages of the liquid dividing module 12. As described above, the liquid inlet 110 is surrounded by a seal groove with a seal gasket (not shown in FIG. 3) in the illustrated embodiment, but it will be appreciated that the liquid outlet 112 or both of these elements may include such a seal groove in other embodiments. The liquid outlet 112 is configured to be aligned into fluid communication with an inlet on the dispensing module 26 connected to the liquid dividing module 12. To this end, the incoming flow of adhesive from the manifold 22 enters the liquid dividing module 12 at the liquid inlet 110 and then a full volume flow or a partial volume flow is delivered from the liquid dividing module 12 to the dispensing module 26 via the liquid outlet 112. The liquid inlet 110 and the liquid outlet 112 both have the appearance of two adjacent and optionally partially overlapping inlets/outlets based upon the formation of the internal passages described in further detail below, but these are treated as a single inlet 110 and a single outlet 112 for purposes of the functional discussion herein.

The liquid dividing module 12 shown in this embodiment also includes a first internal passage 114 and a second internal passage 116 extending between the liquid inlet 110 and liquid outlet 112, as shown most clearly in FIGS. 4 and 5. The first internal passage 114 includes two passage portions 114*a*, 114*b* which are angled from one another. This relative angling of the passage portions 114*a*, 114*b* (each of which is a straight bore in the illustrated embodiment) enables the first internal passage 114 to bend around the central valve chamber 106 within the liquid dividing module 12. The specific path taken by the first internal passage 114 may be modified in other embodiments without departing from the scope of this disclosure, but it will be understood that the two passage portions 114*a*, 114*b* of the illustrated embodiment are easily manufactured by drilling a straight bore into the liquid dividing module 12 from the corresponding proximal and distal walls 76, 74 thereof. As will be readily understood, the incoming flow of adhesive from the liquid discharge outlet 24 of the manifold 22 is divided into a first partial flow of adhesive in the first internal passage 114 and a second partial flow of adhesive in the second internal passage 116. The first partial flow of adhesive continuously moves directly from the liquid inlet 110 to the liquid outlet 112 via the first internal passage 114 without flowing through the central valve chamber 106. Accordingly, even when the valve structure within the liquid dividing module 12 is closed, this first partial flow of adhesive is delivered into the dispensing module 26 to provide a reduced volume flow of adhesive for selective discharge onto the substrate.

Returning to the internal structural features shown in FIGS. 4 and 5, the second internal passage 116 also includes two passage portions 116*a*, 116*b* which each intersect and communicate with the central valve chamber 106. More particularly, one of the passage portions 116*a* is a straight bore which extends between the liquid inlet 110 and the central valve chamber 106, and the other of the passage portions 116*b* is a straight bore which extends between the central valve chamber 106 and the liquid outlet 112. As set forth in further detail below, the liquid dividing module 12 includes a valve member 118 which selectively opens and closes flow by engaging with a first valve seat 120 (shown and described with further reference to FIGS. 6 and 7 below). This first valve seat 120 is located between an outlet 122*a* of the passage portion 116*a* which extends between the liquid inlet 110 and the central valve chamber 106, and an inlet 122*b* of the passage portion 116*b* which extends between the central valve chamber 106 and the liquid outlet 112. Thus, the opening and closing of the valve member 118 against the first valve seat 120 in the liquid dividing module 12 controls whether the second partial flow of adhesive moves into the second of the passage portions 116*b* for flow to the liquid outlet 112, so as to define a full volume flow when combined with the first partial flow of adhesive. When the valve member 118 is closed against the first valve seat 120, the second partial flow of adhesive is recirculated through the outlet recirculation passage 108 back to the manifold 22 instead of being delivered to the dispensing module 26. As a result, the flow through the second internal passage 116 determines whether the liquid dividing module 12 provides a full volume flow or a partial/reduced volume flow to the corresponding dispensing module 26. Once again, although the passage portions 116*a*, 116*b* of the second internal passage 116 are shown as separated straight bores for ease of manufacturing in the illustrated embodiment, the particular shape and layout of these passage portions 116*a*, 116*b* may be modified in other embodiments.

Finally, continuing to move downwardly from the liquid inlet 110 and liquid outlet 112 shown in FIGS. 2 and 3, the liquid dividing module 12 also includes a process air inlet 124 located along the proximal wall 76 generally underneath the liquid inlet 110 and a process air outlet 126 located along the distal wall 74 generally underneath the liquid outlet 112. The process air inlet 124 is configured to be aligned into fluid communication with one of the process air outlets provided at the manifold 22, thereby enabling an incoming flow of process air to be received within a process air transmission passage 128 extending through the liquid dividing module 12. As described above, the process air inlet 124 is surrounded by a seal groove with a seal gasket 86 in the illustrated embodiment, but it will be appreciated that the process air outlet 126 or both of these elements may include such a seal groove in other embodiments. The process air outlet 126 is configured to be aligned into fluid communication with an inlet on the dispensing module 26 connected to the liquid dividing module 12. The process air inlet 124 and the process air outlet 126 both have the appearance of two adjacent and optionally partially overlapping inlets/outlets based upon the formation of the internal passages (e.g., drilled straight bores as described above for other similar passage segments or portions), but these are treated as a single inlet 124 and a single outlet 126 for purposes of the functional discussion herein.

Turning to FIGS. 4 and 5, which show most of the solid structure of the liquid dividing module 12 in phantom so as to reveal paths of internal passages in this liquid dividing module 12, the process air transmission passage 128 includes four passage segments 128*a*, 128*b*, 128*c*, 128*d* which are straight bores angled from one another. More specifically, two of the passage segments 128*a*, 128*b* extend between the process air inlet 124 and the process air outlet 126 while bending around the central valve chamber 106 on one lateral side, while the other two of the passage segments 128*c*, 128*d* extend between the process air inlet 124 and the process air outlet 126 while bending around the central valve chamber 106 on an opposite lateral side. This relative angling of the passage segments 128*a*, 128*b* and 128*c*, 128*d* enables the process air transmission passage 128 to bend around the internal central structure such as a bottommost end of the central valve chamber 106. The specific path taken by the process air transmission passage 128 may be modified in other embodiments without departing from the scope of this disclosure. However, the straight bore passage segments 128*a*, 128*b*, 128*c*, 128*d* enable the full flow of process air received in the liquid dividing module 12 from the manifold 22 to be delivered into the dispensing module 26, such as for use when the dispensing module 26 is a non-contact spray nozzle which uses process air to control the adhesive discharge. It will further be understood that the process air transmission passage 128 may be omitted or plugged when the dispensing module 26 used is a contact dispenser or a non-contact dispenser that does not require the use of process air for adhesive discharge and control.

Figure 6:
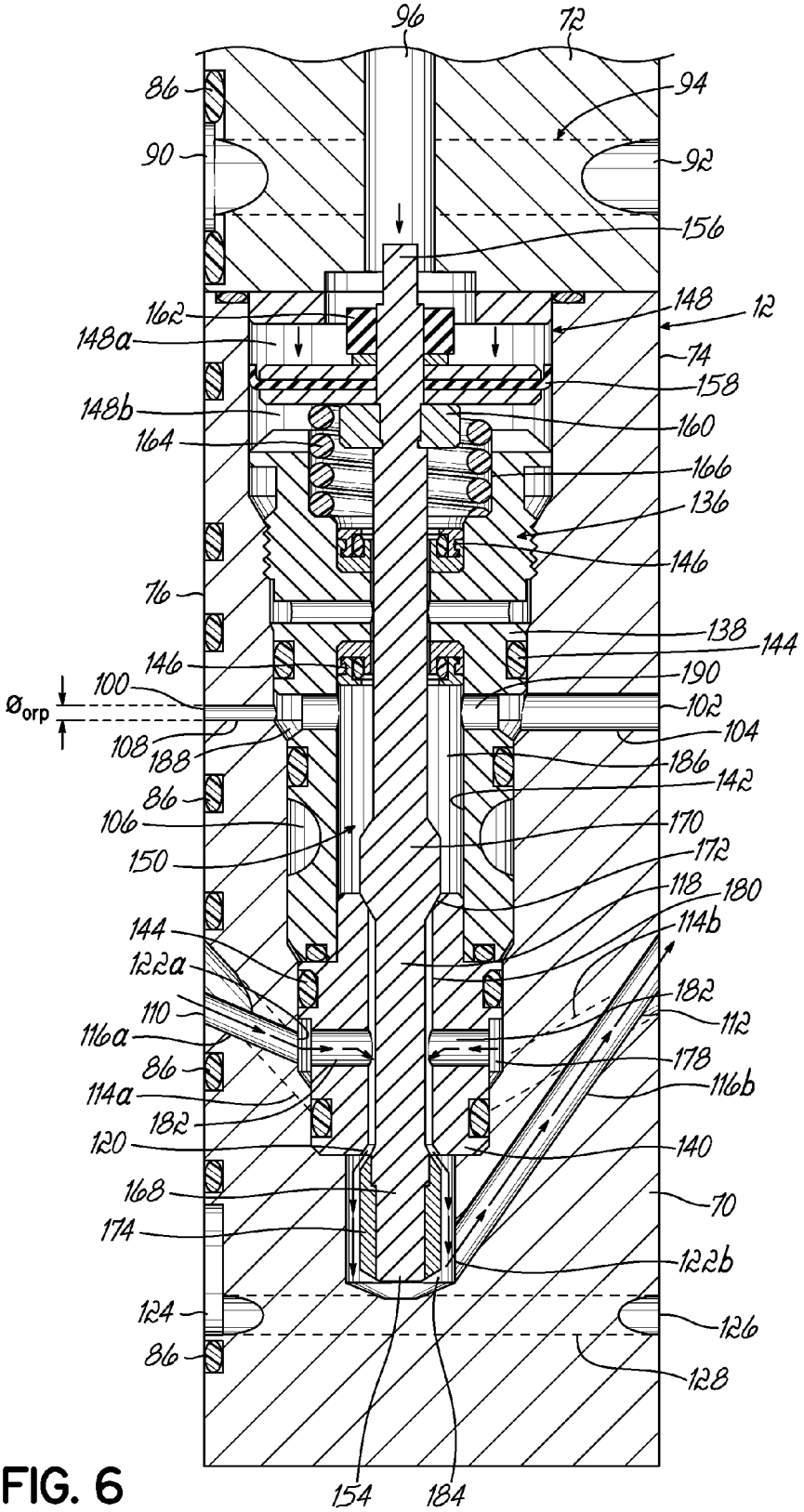
FIG. 6 is a side cross-sectional view of the liquid dividing module of FIG. 2, taken along line 6-6 in FIG. 3 so as to show a valve member of the liquid dividing module in an open position to deliver full volume flow to a liquid outlet thereof.
Figure 7:
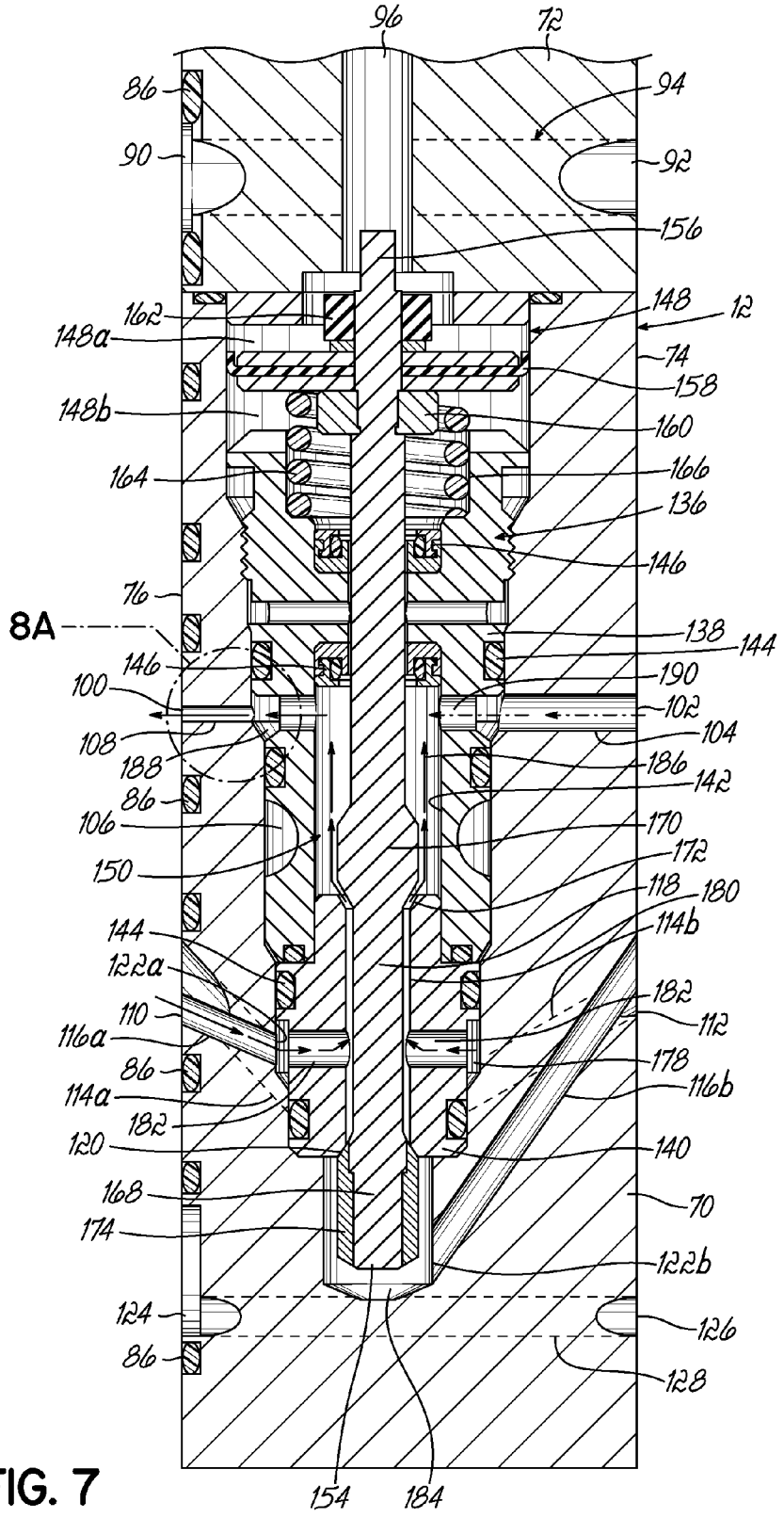
FIG. 7 is a side cross-sectional view of the liquid dividing module similar to FIG. 6, taken along line 6-6 in FIG. 3 so as to show the valve member of the liquid dividing module in a closed position to recirculate a portion of the flow through the liquid dividing module, thereby to deliver only a reduced volume flow to the liquid outlet thereof.

With reference to FIGS. 6 and 7, the internal structure and components of the liquid dividing module 12 are shown in further detail along the cross section 6-6 in FIG. 3. Each of the inlets, outlets, and internal passages described above with reference to FIGS. 2 through 5 are visible again in this cross section, although some of the passages which angle around the central valve chamber 106 are shown in phantom. FIG. 6 specifically illustrates a first open operating state of the liquid dividing module 12, in which the second partial flow of adhesive is allowed to flow to the liquid outlet 112 for delivery into the dispensing module 26, while FIG. 7 specifically illustrates a second closed operating state of the liquid dividing module 12, in which the second partial flow of adhesive is forced to recirculate to the manifold 22 via the liquid recirculation outlet 100. Various flow arrows are shown in these illustrations to provide clarity regarding the flow occurring through the liquid dividing module 12, and particularly within the central valve chamber 106 of the liquid dividing module 12.

As described previously, the central valve chamber 106 in the liquid dividing module 12 communicates with the passage portions 116*a*, 116*b* of the second internal passage 116 as well as with an inlet recirculation passage 104 extending from the dispensing module 26 and an outlet recirculation passage 108 leading to the manifold 22. The control air passage 94, the first internal passage 114, and the process air transmission passage 128 all bend around the central structure within the liquid dividing module 12 so as to not intersect with the central valve chamber 106. In this regard, the control air, the process air, and the first partial flow of adhesive move continuously through the liquid dividing module 12 from the manifold 22 into the dispensing module 26. The following description focuses on the internal valve structure and functionality of elements within the central valve chamber 106 of the liquid dividing module 12.

The central valve chamber 106 receives a valve stem casing, shown in the form of a removable cartridge 136. The removable cartridge 136 includes an upper cartridge portion 138, a lower cartridge portion 140, and a central through-bore 142 extending axially through the upper and lower cartridge portions 138, 140. The upper cartridge portion 138 of this embodiment is configured to be threadably engaged with a corresponding threaded portion of the central valve chamber 106; however, it will be understood that the removable cartridge 136 may be secured in position by other known methods in other embodiments. The upper and lower cartridge portions 138, 140 generally reduce in diameter or cross section moving downwardly (in the orientation shown in FIGS. 6 and 7) to match a similar stepped reduction in bore diameter defined along the length of the central valve chamber 106. The matching size and shape of the upper and lower cartridge portions 138, 140 with the central valve chamber 106, in combination with a plurality of annular seal gaskets 144 on the outer periphery of the upper and lower cartridge portions 138, 140, reduces the likelihood of any air or adhesive leaks from or between portions of the central valve chamber 106.

The central through-bore 142 is adapted to receive the valve member 118, such that the valve member 118 is freely moveable along its longitudinal or central axis between open and closed positions. The removable cartridge 136 includes an interior seal assembly 146 located at the upper cartridge portion 138, this interior seal assembly 146 including dynamic seal gaskets which engage with the valve member 118 to prevent leakage between a piston chamber 148 defined by the central valve chamber 106 above the interior seal assembly 146 and an adhesive chamber 150 defined by the removable cartridge 136 and the central valve chamber 106 below the interior seal assembly 146. At all other locations along the length of the removable cartridge 136 (except selectively at two valve seats described below), the central through-bore 142 is sized to be larger than the valve member 118 to enable air or adhesive flow around the valve member 118 as required for proper functionality of the liquid dividing module 12.

The valve member 118 includes a lower stem end 154 extending through and beyond a terminal end of the lower cartridge portion 140 and an upper stem end 156 extending through and beyond a terminal end of the upper cartridge portion 138 into the piston chamber 148. The piston chamber 148 is more specifically formed collectively by an inner surface of the liquid control section 70 defining the central valve chamber 106, a lower surface of the control air section 72, and the terminal end of the upper cartridge portion 138. A piston 158 is mounted to the valve member 118 proximate the upper stem end 156, such as be being secured between a lower locking nut 160 and an upper locking nut 162 as shown in the illustrated embodiment. The piston 158 therefore moves within the piston chamber 148 in the direction of the longitudinal axis of the removable cartridge 136 or of the valve member 118, when the valve member 118 moves upwardly and downwardly. To this end, movements of the piston 158 effectively drive the movement of the valve member 118 between the open and closed positions. It will be understood that the piston 158 is sized to be closely received within the piston chamber 148, thereby dividing the piston chamber 148 into an upper piston chamber portion 148*a* and a lower piston chamber portion 148*b*.

The upper piston chamber portion 148*a* is in fluid communication with the central control air passage 96 extending generally vertically through the control air section 72. As described briefly above, the air solenoid 52 associated with the liquid dividing module 12 functions to selectively enable pressurized control air to be delivered into the upper piston chamber portion 148*a* via the central control air passage 96. The pressurized control air pushes the piston 158 downwardly towards the removable cartridge 136 when delivered into the upper piston chamber portion 148*a*. It will be appreciated that the lower piston chamber portion 148*b* may be vented to atmosphere by one or more bores (not shown) to enable movement of the piston 158 without formation of air pressure or vacuum that would impede this piston movement.

To move the piston 158 back away from the removable cartridge 136 when the pressurized control air is not being applied to the upper piston chamber portion 148*a*, a coil compression spring 164 is provided in the lower piston chamber portion 148*b*. More particularly, the coil compression spring 164 is partially received within an upper recess 166 formed in the terminal end of the upper cartridge portion 138 so as to encircle the valve member 118 between this upper recess 166 and the bottom side of the piston 158. As will be readily understood, the coil compression spring 164 applies a biasing force to move the piston 158 upwardly away from the removable cartridge 136, and this biasing force holds the piston 158 and the valve member 118 in an uppermost (closed) position until the pressurized control air is delivered into the upper piston chamber portion 148*a* to overcome the spring bias and push the piston 158 to a lowermost position. Accordingly, the movement of the piston 158 and the valve member 118 between positions is fully controlled by the selective supply of pressurized control air caused by the air solenoid 52 associated with the liquid dividing module 12.

In the illustrated embodiment of the liquid dividing module 12, the valve member 118 defines largely the same diameter or size along most of the length thereof, with two exceptions. To this end, the valve member 118 defines an enlarged first valve element 168 positioned adjacent the lower stem end 154 and an enlarged second valve element 170 located between the lower stem end 154 and the upper stem end 156. These enlarged portions of the valve member 118 defining the first and second valve elements 168, 170 are positioned in close relation to opposite (upper and lower) terminal ends of the lower cartridge portion 140 when the internal structure is fully assembled as shown in FIGS. 6 and 7. As a result, the lower cartridge portion 140 includes the first valve seat 120 located adjacent the first valve element 168 and a second valve seat 172 located adjacent the second valve element 170. The first and second valve seats 120, 172 are shaped to sealingly engage the corresponding surfaces on the first and second valve elements 168, 170 when those valve elements 168, 170 are brought into contacting engagement with the corresponding first and second valve seats 120, 172.

For example, the enlarged portions defined by the first and second valve elements 168, 170 include angled transitions between the smaller diameter of the remainder of the valve member 118 and the enlarged diameter at the first and second valve elements 168, 170 in the illustrated embodiment, and the first and second valve seats 120, 172 provide angled complementary surfaces to sealingly engage with these angled transitions. However, it will be understood that alternative types of corresponding mirror image surfaces can be provided in the valve elements 168, 170 and in the valve seats 120, 172 in other embodiments consistent with this disclosure.

In order to enable the assembly of the removable cartridge 136 and the valve member 118 as shown in this embodiment, the enlarged first valve element 168 may be defined by a separately formed sleeve 174 fixed to the lower stem end 154 of the valve member 118. To this end, in the final assembled position shown in FIGS. 6 and 7, the enlarged first and second valve elements 168, 170 sandwich opposite ends of the lower cartridge portion 140, and similarly, the enlarged second valve element 170 is located between the interior seal assembly 146 which closely engages the valve member 118 and the lower cartridge portion 140. These structures could not be assembled in this arrangement without making at least the first valve element 168 adaptable to pass through the central bore through the lower cartridge portion 140. Consequently, the sleeve 174 is fixedly coupled to the lower stem end 154 after insertion of the lower stem end 154 through the bore of the lower cartridge portion 140.

In sum, these elements are assembled into the central valve chamber 106 by (1) inserting the upper stem end 156 of the valve member 118 through the interior seal assembly 146 of the upper cartridge portion 138, (2) inserting the lower stem end 154 (without the sleeve 174) through the lower cartridge portion 140, (3) connecting the upper and lower cartridge portions 138, 140 together with one another, (4) coupling the sleeve 174 to the lower stem end 154 to form the first valve element 168 of the valve member 118, (5) assembling the piston 158 to the upper stem end 156 with the lower and upper locking nuts 160, 162, and (6) inserting the assembly into the central valve chamber 106 from the top end of the liquid control section 70 and securing the assembly in position using the threaded engagement of the upper cartridge portion 138 with the central valve chamber 106. It will be understood that other assembly methods could be used in alternative embodiments, and elements like the separately formed sleeve 174 may be replaced or removed in such embodiments when not necessary to assemble the valve and cartridge components.

The removable cartridge 136 and central valve chamber 106 collectively define several additional passages or chambers for the adhesive flowing to and from the manifold 22 and the dispensing module 26. The lower cartridge portion 140 and central valve chamber 106 are spaced apart from one another adjacent the outlet 122*a* of the passage portion 116*a* of the second internal passage 116, thereby defining an inflow annular chamber 178 configured to receive the second partial flow of adhesive flowing in that passage portion 116*a*. The lower cartridge portion 140 also includes a central cartridge bore 180 extending between the first and second valve seats 120, 172 (e.g., the portion of valve member 118 between the first and second valve elements 168, 170 extends through this central cartridge bore 180 as well), the central cartridge bore 180 being in fluid communication with the inflow annular chamber 178 via one or more inflow bores 182 drilled through the lower cartridge portion 140 as shown in the Figures. In this regard, the second partial flow of adhesive flows from the passage portion 116*a* through the inflow annular chamber 178 and inflow bores 182 into the central cartridge bore 180, which directs the flow upwardly or downwardly depending on the open/closed state of the valve elements 168, 170 as described further below.

The central valve chamber 106 further includes an outflow chamber 184 extending below the lower cartridge portion 140 when the liquid dividing module 12 is fully assembled. This outflow chamber 184 communicates with the central cartridge bore 180 whenever the first valve element 168 is spaced apart from the first valve seat 120, such as in the operating state shown in FIG. 6 (also referred to as the open position). The outflow chamber 184 is also in communication with the inlet 122*b* of the passage portion 116*b* of the second internal passage 116 which communicates with the liquid outlet 112. Therefore, when the valve member 118 is moved downwardly to the so-called open position, the second partial flow of adhesive flows through the internal passages and chambers of the liquid dividing module 12 as shown by flow arrows in FIG. 6 so as to allow the second partial flow of adhesive to travel from the liquid inlet 110 to the liquid outlet 112.

The upper cartridge portion 138 defines a central recirculation bore 186 located above the lower cartridge portion 140 and below the interior seal assembly 146. The portion of the valve member 118 including the enlarged second valve element 170 is positioned to extend through this central recirculation bore 186. Furthermore, the upper cartridge portion 138 and central valve chamber 106 are spaced apart from one another adjacent the inlet recirculation passage 104 and the outlet recirculation passage 108, thereby defining a recirculation annular chamber 188 configured to receive any flows of adhesive being recirculated from the dispensing module 26 and/or the liquid dividing module 12 to the manifold 22. The central recirculation bore 186 is in fluid communication with the recirculation annular chamber 188 via one or more outflow bores 190 drilled through the upper cartridge portion 138 as shown in the Figures. As such, recirculation flows of adhesive from the dispensing module 26 and from the liquid dividing module 12 can be collected in the recirculation annular chamber 188 for return to the manifold 22 via the outlet recirculation passage 108.

In operation, the central recirculation bore 186 communicates with the central cartridge bore 180 whenever the second valve element 170 is spaced apart from the second valve seat 172, such as in the operating state shown in FIG. 7 (also referred to as the closed position in view of the second partial flow of adhesive being blocked from flow to the liquid outlet 112). Therefore, when the valve member 118 is moved upwardly to the so-called closed position, the second partial flow of adhesive flows through the internal passages and chambers of the liquid dividing module 12 as shown in FIG. 7 so as to allow the second partial flow of adhesive to travel from the liquid inlet 110 into the central recirculation bore 186 and then through the outflow bores 190, recirculation annular chamber 188, and outlet recirculation passage 108 back to the manifold 22. This flow action shown by flow arrows in FIG. 7 recirculates the second partial flow of adhesive instead of delivering it to the dispensing module 26, thereby defining the reduced volume flow state for the dispensing module 26.

Having described the recirculation flow that can occur in the liquid dividing module 12 when in the closed position, a further benefit or functionality of the liquid dividing module 12 can now be clarified. More specifically, the outlet recirculation passage 108 is a drilled bore with a specifically controlled size, shown as the diameter $Ø_{ORP}$ in FIGS. 6 and 8, and this size is selected or controlled so as to control the relative amounts of adhesive flow in the first and second partial flows of adhesive formed by the liquid dividing module 12. When the liquid dividing module 12 is in the closed position, the first partial flow of adhesive is discharged to the dispensing module 26 while the second partial flow of adhesive flows to the outlet recirculation passage 108 as shown and described above in connection with FIG. 7. These two flow paths through the liquid dividing module 12 and through the dispensing applicator 10 in its entirety inherently define respective pressure drops or flow resistances to the first and second partial flows of adhesive.

In one exemplary embodiment, the diameter $Ø_{ORP}$ is about 0.030 inch, which causes the pressure drop through the recirculation path to be about the same as the pressure drop through the dispensing path. Accordingly, this selected diameter for the outlet recirculation passage 108 causes the flow resistance to be equal for the first and second partial flows of adhesive, thereby resulting in effectively an equal split of the flow at the liquid inlet 110 (e.g., the first partial flow is about 50% of the total adhesive flow and the second partial flow is also about 50% of the total adhesive flow). When in this closed position, the applicator 10 and the liquid dividing module 12 therefore operate as a pressure based system, and this enables the control of the relative amounts in the first and second partial flows of adhesive by adjusting or controlling the size of the outlet recirculation passage 108 (e.g., because this size helps determine the overall pressure drop in the recirculation path). If a different split of the volume is desired, such as 70/30% flow in the reduced volume flow state, the diameter $Ø_{ORP}$ of the outlet recirculation passage 108 can be modified in other non-illustrated embodiments to provide such a result without departing from the scope of this disclosure. Generally speaking, as the outlet recirculation passage 108 decreases in size, the percentage of flow contained in the second partial flow of adhesive also decreases in size, thereby reducing the percentage volume reduction in the reduced volume flow state compared to the full volume flow state. Nevertheless, the many dispensing applications will require a 50/50% volume split, as advantageously provided in the illustrated embodiment shown in FIGS. 6 and 8.

The outlet recirculation passage 108 shown in the embodiment of FIGS. 6 and 8 defines a fixed or predetermined diameter $Ø_{ORP}$. As a result, whenever the desired percentage balance between the first and second partial flows of adhesive needs to be modified for the liquid dividing module 12, the applicator 10 must be disassembled so that a new liquid dividing module 12 having an outlet recirculation passage 108 drilled to define a different diameter $Ø_{ORP}$ can be inserted into the applicator 10. In some dispensing applications or fields, this fixed volume reduction may be desirable because changes in the amount of flow in the full volume flow and reduced volume flow states may not be necessary or may be very rare. However, in other fields or applications, it may be desirable to provide more control over the extent of the volume reduction enabled by the liquid dividing module 12 on a recurring or regular basis. Accordingly, an alternative embodiment of a liquid dividing module 12*x* is also provided in this disclosure for the purposes of enabling actual control over the volume reduction developed as a result of the pressure drop developed when the liquid dividing module 12 and the applicator 10 are operated as a pressure based system.

Figure 8A:
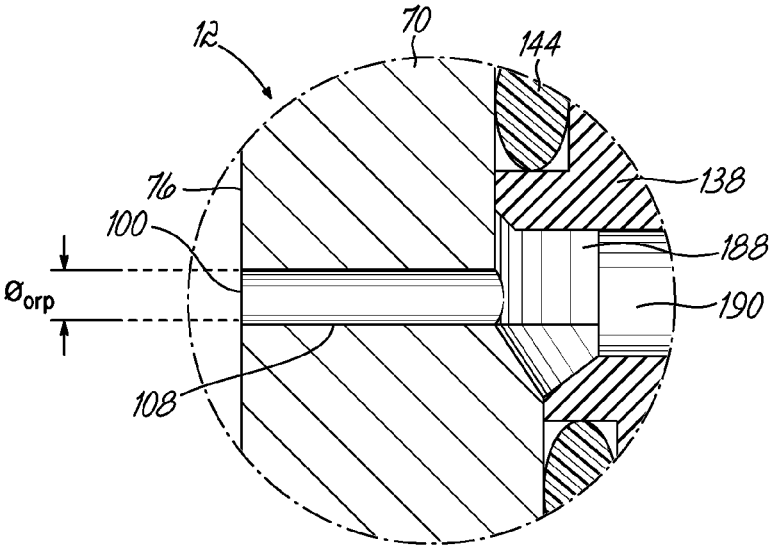
FIG. 8A is a detail cross-sectional view of the portion of the liquid dividing module of FIG. 7 (as identified by circle 8A in FIG. 7) including an outlet recirculation passage defining a fixed diameter configured to control recirculation flow from the liquid dividing module.
Figure 8B:
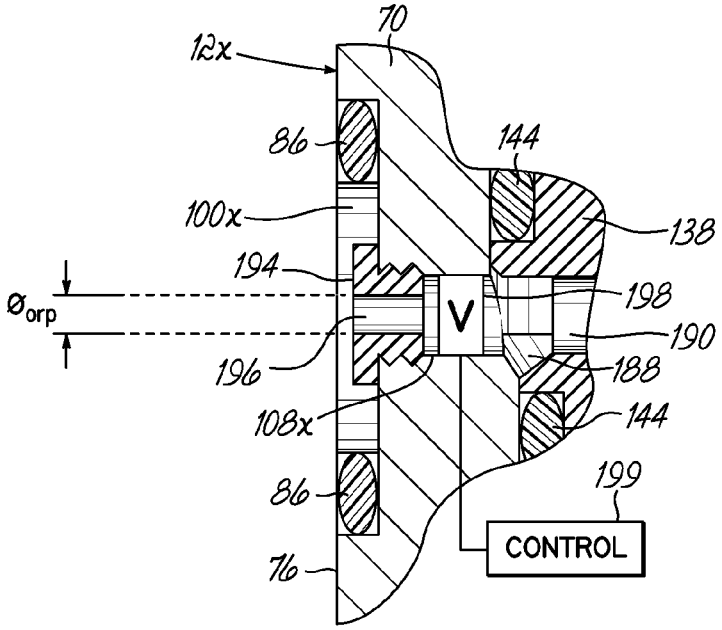
FIG. 8B is a detail cross-sectional view of an alternative arrangement for the liquid dividing module at the outlet recirculation passage, such as by including one or more control mechanisms for varying the size of the outlet recirculation passage.

The liquid dividing module 12*x* of such an alternative embodiment is precisely identical to the liquid dividing module 12 described above, with the only exceptions being highlighted in FIG. 8B and described below. To this end, FIG. 8B illustrates the portion of the liquid dividing module 12*x* located adjacent the outlet recirculation passage 108*x* thereof, this passage being modified from the similar structure shown most clearly in analogous FIG. 8A for the previous embodiment. The outlet recirculation passage 108*x* of this liquid dividing module 12*x* includes one or more features which enable adjustment of the diameter $Ø_{ORP}$ of the outlet recirculation passage 108*x*, which therefore also adjusts the pressure drop in the recirculation path and the corresponding volume reduction when in the partial volume state for the same reasons described above.

In this regard, the liquid dividing module 12*x* includes a threaded bead tip 194 which engages into threaded engagement with the modified outlet recirculation passage 108*x* of this embodiment. The threaded bead tip 194 includes an internal bore 196 which defines the smallest diameter $Ø_{ORP}$ of the outlet recirculation passage 108*x* after installation. As will be readily understood, different threaded bead tips 194 with varying diameters of the corresponding bores 196 could be provided to the end user of the liquid dividing module 12 so that only the threaded bead tip 194 must be replaced when the reduction of volume caused by the liquid dividing module 12*x* is to be modified. Of course, the liquid recirculation outlet 100*x* of this embodiment is then likewise modified to provide sufficient clearance around the head of the threaded bead tip 194 so as to enable this removal and replacement of the threaded bead tip 194 when desired by the end user. Although the threaded bead tip 194 extends along only a partial portion of the length of the outlet recirculation passage 108*x* in this embodiment, it will be appreciated that the threaded bead tip 194 may be modified to extend along more or less of the length of the outlet recirculation passage 108*x* in other embodiments. It will also be understood that other similar types of diameter-changing inserts may be used in similar alternative embodiments to provide the same functionality and control to the end users of the liquid dividing module 12*x*.

In addition to (as shown in FIG. 8B) or as an alternative to the threaded bead tip 194, the outlet recirculation passage 108*x* may be provided with a flow valve mechanism 198 which actively controls the flow passing through the outlet recirculation passage 108*x*. In most embodiments of the liquid dividing module 12*x*, only one of these features (194 and 198) will be included, but both are shown in FIG. 8B for the sake of drawing efficiency. The flow valve mechanism 198 and the flow enabled therethrough may be adjusted by a control 199, which may be a manual adjustment control like a knob provided on the liquid dividing module 12*x* or an automatic control such as the control unit 50 of the applicator 10 described above. In such an alternative embodiment, the percent reduction of flow enabled by the liquid dividing module 12*x* can be modified without disassembling the liquid dividing module 12*x* from the dispensing module 26 and the manifold 22. However, such an embodiment also necessitates additional control logic or knobs, which may be deemed unnecessary by certain types of end users. Whether using the liquid dividing module 12 with a fixed size outlet recirculation passage 108 or one of these alternative embodiments with additional features as shown in FIG. 8B, the functionality of the module can be adjusted (in the pressure based system or recirculation operation) to meet the specific needs of the end user.

To summarize the operation of these embodiments, the liquid dividing module 12 advantageously divides the incoming full volume flow from the manifold 22 into first and second partial flows of adhesive, the first of which is continuously delivered into the dispensing module 26 and the second of which is controlled to either flow to the dispensing module 26 or be recirculated back to the manifold 22. When the air solenoid 52 causes pressurized control air to flow into the upper piston chamber portion 148*a* and move the piston 158 and valve member 118 downwardly to the open position shown in FIG. 6, the second valve element 170 sealingly closes against the second valve seat 172 while the first valve element 168 is moved a small distance apart from the first valve seat 120. Thus, incoming flow of the second partial flow of adhesive is routed to the liquid outlet 112 so as to be rejoined with the first partial flow of adhesive before delivery as a full volume flow into the dispensing module 26.

When the pressurized control air is no longer delivered into the upper piston chamber portion 148*a*, the piston 158 is forced by the coil compression spring 164 to move upwardly to the closed position shown in FIG. 7. In this closed position, the first valve element 168 sealingly closes against the first valve seat 120 while the second valve element 170 is moved a small distance apart from the second valve seat 172. Thus, incoming flow of the second partial flow of adhesive is routed to the central recirculation bore 186 and to the outlet recirculation passage 108 so as to be recirculated to the manifold 22, leaving only the first partial flow of adhesive to flow into the dispensing module 26 as a reduced volume flow state.

In an exemplary embodiment such as that shown in FIGS. 2 through 8A, the movement of the piston 158 and the valve member 118 between these positions can be defined by a short overall stroke length, such as a stroke length of about 0.020 inch. Accordingly, the movement of the valve member 118 to change between these full volume flow and reduced volume flow states is nearly instantaneous from when the control signal is provided to operate the air solenoid 52. And as the liquid dividing module 12 provides this functionality directly in line with and between the manifold 22 and the dispensing module 26, the selective and nearly instantaneous reduction of flow volume advantageously occurs adjacent to and immediately before discharge of the adhesive at the dispensing module 26. To this end, the liquid dividing module 12 enables the dispensing applicator 10 to be highly responsive and quick to change dispensing states between reduced volume flow and full volume flow, as may be required when dispensing controlled patterns of adhesive onto a substrate. Consequently, many different flow patterns can be predictably and reliably achieved using an applicator 10 with the liquid dividing modules 12, with several example flow patterns described below with reference to FIGS. 9A through 9D.

As described above, the various outlets and inlets located along the distal wall 74 side of the liquid dividing module 12 supply process air, control air, and adhesive into the dispensing module 26. The dispensing module 26 may be any one of a number of known modules used for non-contact dispensing like spray applications, or used for contact dispensing like slot coating. For example, the dispensing module 26 could be a module in accordance with that described in U.S. Pat. No. 6,089,413, which is owned by the assignee of the present application. Alternatively, the dispensing module 26 could be provided with internal valve and cartridge structure substantially similar to that described above for the liquid dividing module 12. Regardless of the particular type and design of dispensing module 26 that is to be chosen, the dispensing module 26 must provide the capability to receive adhesive flow from the liquid dividing module 12 and then control whether that adhesive flow is dispensed to a substrate or recirculated, e.g., via the liquid dividing module 12 to the manifold 22. More particularly, the dispensing module 26 is capable of rapidly switching between the liquid dispensing mode, which discharges the received adhesive flow onto a substrate, and the recirculation mode, which returns the received adhesive to the liquid dividing module 12 for flow back into the manifold 22.

Although not shown in the sole illustration of a generalized dispensing module 26 at FIG. 1, the dispensing module 26 is typically configured to discharge the full or reduced volume flow of adhesive in the liquid dispensing mode through a dispensing nozzle removably coupled with the dispensing module 26. To this end, the dispensing module 26 further includes a nozzle retaining clamp 206 having a clamp screw 208 threadably engaged with the nozzle retaining clamp 206 so that the clamp 206 can releasably retain the dispensing nozzle in position at the bottom end of the dispensing module 26. As a result, the dispensing module 26 can be reconfigured to function with different types of dispensing without necessitating disassembly of the applicator 10 or replacement of the entire module. This and other functionality and benefits of the known dispensing module designs, including those typically connected directly to the manifold segments 18 of manifold 22 without the inclusion of liquid dividing modules 12 in conventional applicators, will be readily appreciated by those skilled in the adhesive dispensing art.

Therefore, the variable output dispensing applicator 10 of the illustrated embodiment advantageously enables near-instantaneous transitions between a full volume flow, a reduced volume flow, and no volume flow at each set of liquid dividing module 12 and its corresponding dispensing module 26 across the width of the applicator 10. The transition between the full and reduced volume flows is specifically enabled by the provision of the liquid dividing module 12 of the current disclosure. When each of the dispensing modules 26 is configured to dispense adhesive onto a strip or lane of the substrate that is 25 millimeters wide, for example, the pattern can be modified in both contact and non-contact dispensing applications both along the machine direction or length of the substrate and in the transverse direction or across the width of the substrate (in 25 millimeter increments). This functionality results in any number of precise patterns being provided across a two-dimensional space defined by the substrate, and several examples of these patterns are shown in FIGS. 9A through 9D.

Figure 9A:
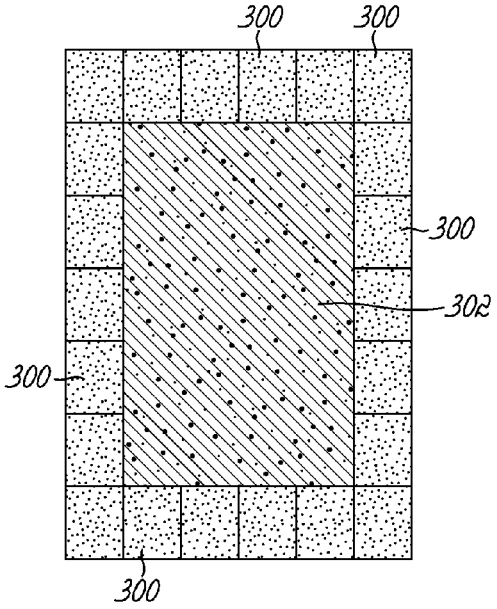
FIG. 9A is a schematic top view of a first adhesive deposition pattern using zones of full adhesive output and zones of reduced adhesive output in accordance with a first embodiment of use of the applicator of FIG. 1 (which includes the liquid dividing module of FIGS. 2 through 7), the first adhesive deposition pattern defining a box-shaped pattern.
Figure 9B:
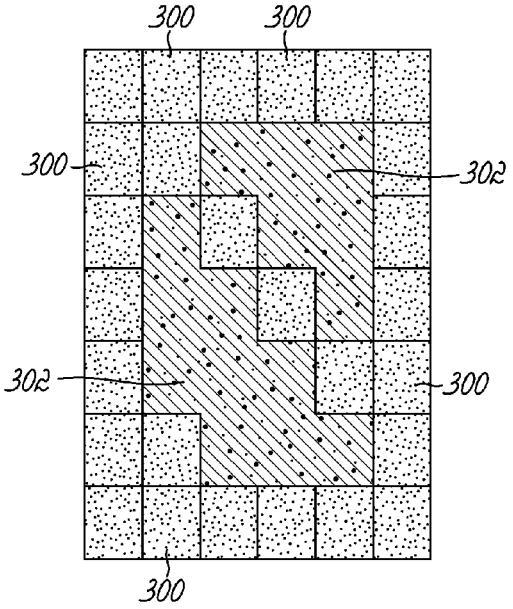
FIG. 9B is a schematic top view of a second adhesive deposition pattern using zones of full adhesive output and zones of reduced adhesive output in accordance with a second embodiment of use of the applicator of FIG. 1 (which includes the liquid dividing module of FIGS. 2 through 7), the second adhesive deposition pattern defining a box-shaped pattern with diagonal lines of full adhesive output extending across the box-shaped pattern.
Figure 9C:
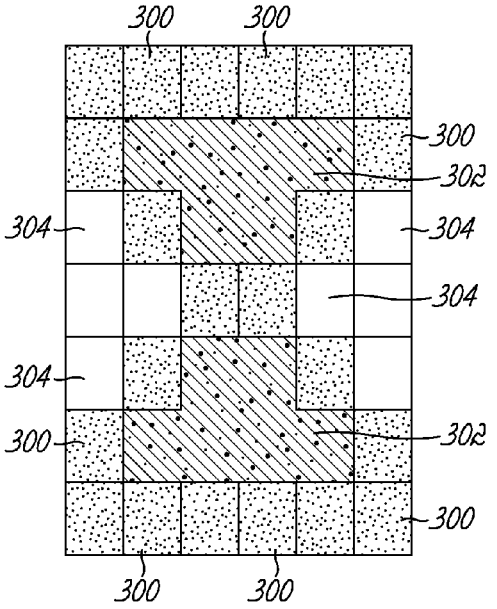
FIG. 9C is a schematic top view of a third adhesive deposition pattern using zones of full adhesive output, zones of reduced adhesive output, and zones of no adhesive output in accordance with a third embodiment of use of the applicator of FIG. 1 (which includes the liquid dividing module of FIGS. 2 through 7), the third adhesive deposition pattern defining an hourglass-shaped pattern.
Figure 9D:
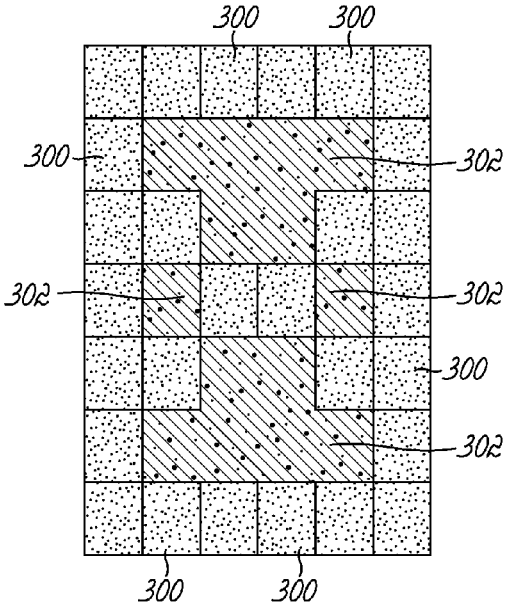
FIG. 9D is a schematic top view of a fourth adhesive deposition pattern using zones of full adhesive output and zones of reduced adhesive output in accordance with a fourth embodiment of use of the applicator of FIG. 1 (which includes the liquid dividing module of FIGS. 2 through 7), the fourth adhesive deposition pattern defining a X-shaped and box-shaped pattern of full adhesive output in combination.

More specifically, the control unit 50 operates the air solenoids 52 and the associated valve structures within the liquid dividing modules 12 and the dispensing modules 26 to produce the varied volume zones of adhesive on the substrate, thereby generating patterns such as the box-shaped pattern in FIG. 9A, the striped pattern in FIG. 9B, the hourglass-shaped pattern in FIG. 9C, the X-shaped pattern in FIG. 9D, and other readily understood or desirable deposition patterns. Furthermore, the dispensing width of the pattern to be applied to the substrate may be quickly modified simply by placing the dispensing modules 26 of all lanes/strips not to be used into a recirculation mode for a given substrate. The applicator 10 does not need reconfigured each time the pattern or dispensing width needs to be modified.

With specific reference to FIG. 9A, which is a box-shaped pattern of adhesive, the pattern generated by the control unit 50 and the applicator 10 includes zones of full adhesive flow 300 forming a perimeter around an internal area defined by zones of reduced adhesive flow 302 on the substrate. The zones of full adhesive flow 300 are shown in box-like partial portions to help clarify the operation, but it will be appreciated that these zones will combine together into a unitary full volume perimeter in actual dispensed patterns on the substrate.

To form the pattern of FIG. 9A, six sets of liquid dividing modules 12 and dispensing modules 26 are controlled using the control unit 50. As described above, each of the liquid dividing modules 12 is dividing a flow of adhesive from the corresponding manifold segment 18 into first and second partial flows, one of which is always delivered into the dispensing module 26 and the other of which is controlled by the valve member 118. Each of the dispensing modules 26 controls whether the incoming adhesive from the liquid dividing module 12 is dispensed onto the substrate or recirculated back to the manifold segment 18 via the liquid dividing module 12. To this end, for a first set of zones shown at the uppermost part of the pattern in FIG. 9A, the control unit 50 actuates the air solenoids 52 for both the liquid dividing module 12 and the dispensing module 26 in every one of the six lanes across the width of the pattern or substrate. This causes the full volume flow of adhesive to be delivered by the liquid dividing modules 12 into the dispensing modules 26, and then the full volume flow is discharged from each of the dispensing modules 26, thereby forming a series of zones of full adhesive flow 300. Accordingly, the full volume flow or zones of adhesive are applied across the entire width of the pattern (150 millimeters in width in the example where each zone is 25 millimeters wide).

When the substrate reaches the second set of zones (moving downwardly from the top row of zones shown in FIG. 9A), the control unit 50 switches the operating states of the liquid dividing modules 12 in the second, third, fourth, and fifth lanes but maintains all other air solenoids 52 the same as before. As a result, the dispensing modules 26 in the first and sixth lanes (e.g., the outermost lateral lanes) continue to discharge the full volume flow of adhesive to generate additional zones of full adhesive flow 300 on the substrate. At the same time, the liquid dividing modules 12 in the second through fifth lanes recirculate the second partial flow of adhesive such that only the first partial flow of adhesive is received by the corresponding dispensing modules 26 (because the pistons 158 and valve members 118 of these liquid dividing modules 12 are returned by the spring bias to the closed position), and this reduced flow of adhesive is dispensed by these dispensing modules 26 to form the zones of reduced adhesive flow 302 on the substrate in these central lanes. This process may repeat for a number of zones along the length of the substrate (five shown in FIG. 9A), and then the control unit 50 may actuate all of the air solenoids 52 once again to provide zones of full adhesive flow 300 across the entire width of the substrate to finish the box-shaped pattern. Of course, the amount of volume reduction of adhesive provided in the zones of reduced adhesive flow 302 compared to the zones of full adhesive flow 300 may be modified by changing the size of the outlet recirculation passage 108, 108*x* in the liquid dividing module 12, in any of the manners described above with respect to FIGS. 8A and 8B.

One example of a pattern with zones of no adhesive flow 304 is the hourglass-shaped pattern shown in FIG. 9C. The zones of full adhesive flow 300 are applied across the entire width of the substrate at the beginning and end of the pattern once again, but between those ends, the zones of full adhesive flow 300 are selectively applied so as to generate an X-shaped pattern of full adhesive flow, which leaves spaces above and below the center of the X-shape as well as spaces to the lateral left and right of the center of the X-shape. To finish the hourglass-shaped pattern, the spaces above and below the center of the X-shape are filled with zones of reduced adhesive flow 302 while the spaces to the lateral left and right of the X-shape center are not filled with any adhesive, e.g., by zones of no adhesive flow 304. Consequently, it will be understood that various two-dimensional patterns having a resolution of about 25 millimeters can be formed by using the control unit 50 of the applicator 10 to dispense the full volume flow, the reduced volume flow, and no volume flow where necessary on the zones of the substrate.

After the desired pattern of adhesive is discharged onto the substrate via contact or non-contact dispensing (spray being an example of the latter), the substrate is typically adhered to a separate element using the dispensed pattern of adhesive. For example, the zones of full adhesive flow 300 are used to generate strong structural bonds between the substrate and the separate element, while the zones of reduced adhesive flow 302 are used to stabilize the lamination of the substrate. Furthermore, because the liquid dividing modules 12 are located in line with and between the manifold 22 and the dispensing modules 26, the switching between the full volume flow and the reduced volume flow is nearly instantaneous as a result of the dividing control occurring adjacent to and immediately before dispensing at the dispensing modules 26. And unlike conventional systems where volumes are combined downstream of dispensing control valves, the control unit 50 is able to switch each lane of the applicator 10 between dispensing states without needing to account for a significant period of time following the switch of operational modes of the valve devices in which flow from the previous dispensing state is continued. Therefore, the applicator 10 using the liquid dividing modules 12 is capable of generating various different desired adhesive deposition patterns defined by zones of full adhesive flow 300, zones of reduced adhesive flow 302, and/or zones of no adhesive flow 304 across substrates of varying widths and lengths without necessitating structural re-assembly and reconfiguration of the applicator 10 and its various modules. In this regard, the same applicator 10 may be used for various dispensing operations and product lines of the end user, thereby avoiding the necessity to maintain separate dispensing applicators or systems for each product line.

While the present invention has been illustrated by a description of exemplary embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. However, the invention itself should only be defined by the appended claims.

What is claimed is:

1. A liquid dividing module configured to supply adhesive from a manifold to a dispensing module in a variable output dispensing applicator, the liquid dividing module comprising:

a module body including a proximal wall configured to abut the manifold and a distal wall configured to abut the dispensing module;

a liquid inlet located in said proximal wall and configured to receive a full volume flow of adhesive from the manifold;

a liquid outlet located in said distal wall and configured to deliver the full volume flow or a reduced volume flow of adhesive to the dispensing module;

a valve chamber positioned within said module body and housing a valve member therein;

a first internal passage extending from said liquid inlet to said liquid outlet;

a second internal passage extending from said liquid inlet to said valve chamber, and from said valve chamber to said liquid outlet, such that the liquid dividing module divides the full volume flow of adhesive at said liquid inlet into a first partial flow of adhesive, which continuously moves to said liquid outlet via said first internal passage, and a second partial flow of adhesive, which moves into said valve chamber via said second internal passage;

a recirculation outlet located in said proximal wall and configured to communicate with the manifold; and a recirculation passage communicating with said valve chamber and said recirculation outlet, said valve member moveable from an open position enabling the second partial flow of adhesive to continue moving through said second internal passage so as to be rejoined with the first partial flow of adhesive to provide the full volume flow at said liquid outlet, to a closed position blocking flow through said second internal passage and thereby providing only the reduced volume flow at said liquid outlet, the second partial flow of adhesive being directed to flow into said recirculation passage towards said recirculation outlet when said valve member is moved to the closed position.

2. The liquid dividing module of claim 1, further comprising:

a recirculation inlet located in said distal wall and configured to receive a recirculation flow of adhesive from the dispensing module, said recirculation inlet being in communication with said recirculation passage such that the recirculation flow of adhesive is passed from said recirculation inlet to said recirculation outlet for return to the manifold.

3. The liquid dividing module of claim 1, said recirculation passage defining part of a recirculation path for adhesive in the liquid dividing module, and said recirculation passage sized to control a percentage drop in flow of adhesive moving between said liquid inlet and said liquid outlet when said valve member closes to provide the reduced volume flow to said liquid outlet.

4. The liquid dividing module of claim 3, said recirculation passage defining a bore with a fixed, predetermined diameter, thereby to provide a fixed percentage drop in flow of adhesive in the reduced volume flow compared to the full volume flow.

5. The liquid dividing module of claim 3, said recirculation passage defining a bore with an adjustable diameter, thereby to provide a variable percentage drop in flow of adhesive in the reduced volume flow compared to the full volume flow.

6. The liquid dividing module of claim 5, further comprising:

a removable bead tip selectively engaged with said bore of said recirculation passage to modify the diameter of said recirculation passage and thereby modify the percentage drop in flow of adhesive in the reduced volume flow compared to the full volume flow.

7. The liquid dividing module of claim 1, further comprising:

a removable cartridge inserted into said valve chamber for interaction with said valve member, said valve chamber and said removable cartridge collectively defining a first path for the second partial flow of adhesive to move between said liquid inlet and said liquid outlet when said valve member is in the open position, and a second path for the second partial flow of adhesive to move between said liquid inlet and said recirculation passage when said valve member is in the closed position.

8. The liquid dividing module of claim 7, said removable cartridge further including a first valve seat located along said first path and a second valve seat located along said second path, and said valve member includes a first enlarged valve element configured to selectively engage with said first valve seat and a second enlarged valve element configured to selectively engage with said second valve seat, said valve member alternatively engaging said first and second valve seats to open flow through one of said first and second paths.

9. The liquid dividing module of claim 1, further comprising:

a piston chamber defined within said module body;

a piston coupled to said valve member for movement with said valve member in said piston chamber; and an air control valve configured to selectively provide pressurized control air into said piston chamber to drive said piston and said valve member between the open and closed positions.

10. The liquid dividing module of claim 9, further comprising:

a central control air passage configured to deliver the pressurized control air from said air control valve to said piston chamber; and a control air supply passage configured to receive pressurized control air from the manifold and deliver the pressurized control air to one or both of the dispensing module and said air control valve, said control air supply passage including multiple passage portions angled from one another such that said control air supply passage bends around said central control air passage.

11. The liquid dividing module of claim 1, further comprising:

a process air transmission passage configured to communicate between the manifold and the dispensing module when pressurized process air is required for spray operations at the dispensing module, said process air transmission passage including multiple passage portions angled from one another such that said process air transmission passage bends around said valve chamber.

12. A method for supplying a variable amount of adhesive from a manifold to a dispensing module of a variable output dispensing applicator using a liquid dividing module having a liquid inlet, a liquid outlet, a recirculation passage configured to return adhesive to the manifold, and a valve member, the method comprising:

dividing a full volume flow of adhesive at the liquid inlet of the liquid dividing module into first and second partial flows of adhesive;

transmitting the first partial flow of adhesive continuously to the liquid outlet of the liquid dividing module;

controlling the second partial flow of adhesive in the liquid dividing module, to thereby selectively enable transmission of the second partial flow of adhesive to the liquid outlet in a first operating state, and to selectively block transmission of the second partial flow of adhesive from continuing to move to the liquid outlet in a second operating state;

recombining the first and second partial flows of adhesive at the liquid outlet to deliver the full volume flow of adhesive from the liquid outlet, when the liquid dividing module is in the first operating state;

delivering the first partial flow of adhesive as a reduced volume flow of adhesive from the liquid outlet, when the liquid dividing module is in the second operating state;

moving the valve member to an open position in the first operating state to enable transmission of the second partial flow of adhesive between the liquid inlet and the liquid outlet; and moving the valve member to a closed position in the second operating state to divert the second partial flow of adhesive from the liquid inlet to the recirculation passage wherein controlling the second partial flow of adhesive further comprises:

closing a recirculation path between the liquid inlet and the recirculation passage; and opening the recirculation path between the liquid inlet and the recirculation passage.

13. The method of claim 12, further comprising:

controlling adhesive flow through the liquid dividing module as a pressure-based system, with relative amounts of the first and second partial flows of adhesive determined by pressure drops caused by travel through different passages within the liquid dividing module.

14. The method of claim 13, further comprising:

varying the percentage drop in flow of adhesive caused between the full volume flow of adhesive and the reduced volume flow of adhesive by adjusting the diameter of the bore in the recirculation passage.

15. The method of claim 12, the liquid dividing module being located directly between the manifold and the dispensing module such that controlling the second partial flow of adhesive further comprises:

switching between the full volume flow of adhesive and the reduced volume flow of adhesive at a location adjacent to and immediately before dispensing of the adhesive at the dispensing module.

* * * * *